US008604419B2

(12) United States Patent
Nolting et al.

(10) Patent No.: US 8,604,419 B2
(45) Date of Patent: Dec. 10, 2013

(54) DUAL ION TRAPPING FOR ION/ION REACTIONS IN A LINEAR RF MULTIPOLE TRAP WITH AN ADDITIONAL DC GRADIENT

(75) Inventors: Dirk Nolting, Bremen (DE); Jens Griep-Raming, Ganderkesee (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 882 days.

(21) Appl. No.: 12/700,605

(22) Filed: Feb. 4, 2010

(65) Prior Publication Data

US 2011/0186724 A1 Aug. 4, 2011

(51) Int. Cl.
*H01J 49/42* (2006.01)
*H01J 49/06* (2006.01)

(52) U.S. Cl.
USPC ..... 250/282; 250/281; 250/290

(58) Field of Classification Search
USPC ..... 250/281, 282, 283, 288, 290, 292, 293, 250/294
See application file for complete search history.

(56) References Cited

U.S. PATENT DOCUMENTS

| | | | | |
|---|---|---|---|---|
| 6,737,641 | B2 | 5/2004 | Kato | |
| 7,026,613 | B2 | 4/2006 | Syka | |
| 7,067,802 | B1 * | 6/2006 | Kovtoun | 250/282 |
| 7,145,139 | B2 | 12/2006 | Syka | |
| 7,196,326 | B2 * | 3/2007 | Franzen et al. | 250/288 |
| 7,312,442 | B2 | 12/2007 | Hansen | |
| 7,385,185 | B2 * | 6/2008 | Dowell et al. | 250/281 |
| 7,397,026 | B2 | 7/2008 | Dowell | |
| 7,456,397 | B2 | 11/2008 | Hartmer et al. | |
| 7,514,673 | B2 | 4/2009 | Senko et al. | |
| 7,534,622 | B2 * | 5/2009 | Hunt et al. | 436/173 |
| 7,555,393 | B2 | 6/2009 | Sadygov et al. | |
| 7,595,485 | B1 | 9/2009 | Sadygov et al. | |
| 7,759,637 | B2 * | 7/2010 | Thomson | 250/292 |
| 8,283,628 | B2 * | 10/2012 | Hoyes et al. | 250/282 |
| 2004/0173740 | A1 * | 9/2004 | McLuckey et al. | 250/288 |
| 2005/0098719 | A1 * | 5/2005 | Thomson | 250/288 |
| 2006/0186331 | A1 | 8/2006 | Hartmer et al. | |

(Continued)

FOREIGN PATENT DOCUMENTS

| | | |
|---|---|---|
| GB | 2 389 704 A | 12/2003 |
| GB | 2 392 301 A | 2/2004 |

(Continued)

OTHER PUBLICATIONS

McFarland et al., "Evaluation and Optimization of Electron Capture Dissociation Efficiency in Fourier Transform Ion Cyclotron Resonance Mass Spectrometry," J Am Soc for Mass Spectrom 2005, 16, pp. 1060-1066.

(Continued)

*Primary Examiner* — Bernard E Souw
(74) *Attorney, Agent, or Firm* — Michael C. Staggs

(57) ABSTRACT

A novel method and mass spectrometer apparatus is introduced to enable the simultaneous isolation of cations and anions (i.e., precursor and reagent ions) in a linear multipole ion trap via the application of an additional axial DC gradient in combination with coupled RF potential(s). Thus, the combination of the RF and DC voltages in such an arrangement forms a pseudopotential designed to provide for minima for the trapped positively and negatively charged particles that result in the overlap of the ion clouds so as to provide for beneficial ion/ion reactions.

20 Claims, 11 Drawing Sheets

(56) References Cited

U.S. PATENT DOCUMENTS

| | | | | |
|---|---|---|---|---|
| 2007/0045531 | A1* | 3/2007 | Mordehai et al. | 250/285 |
| 2007/0228268 | A1* | 10/2007 | Marriott | 250/282 |
| 2007/0278397 | A1* | 12/2007 | Bateman et al. | 250/286 |
| 2008/0048109 | A1 | 2/2008 | Schwartz et al. | |
| 2008/0128611 | A1 | 6/2008 | McLuckey et al. | |
| 2008/0245963 | A1 | 10/2008 | Land et al. | |
| 2008/0265155 | A1* | 10/2008 | Kovtoun | 250/292 |
| 2011/0062323 | A1* | 3/2011 | Brown et al. | 250/282 |

FOREIGN PATENT DOCUMENTS

| | | | |
|---|---|---|---|
| GB | 2 435 714 | A | 9/2007 |
| GB | 2 439 814 | A | 1/2008 |
| WO | WO 2005/074004 | A2 | 8/2005 |
| WO | WO 2006/042187 | A2 | 4/2006 |
| WO | WO 2006/103412 | A2 | 10/2006 |
| WO | WO 2006/121668 | A2 | 11/2006 |
| WO | WO 2006/129068 | A2 | 12/2006 |
| WO | WO 2008/069959 | A2 | 6/2008 |
| WO | WO 2010/002819 | | 1/2010 |

OTHER PUBLICATIONS

Vartanian et al., "Simultaneous Trapping of Positive and Negative tons Using a Nested Open-ended Trapped-Ion Cell in Fourier Transform Ion Cyclotron Resonance Mass Spectrometry," Organic Mass Spectrometry, 1994, 29, pp. 692-694.

Malek et al., "FT-ICFR Spectrometry with Simultaneous Trapping of Positive and Negative Ions ," International Journal of Mass Spectrometry and Ion Processes, 157/158 (1996), pp. 199-214.

Malek et al., "Trapping and Excitation of Ions in a Double Well Potential," Rapid Commun. Mass Spectrom., 1997, 11, pp. 1616-1618.

Dieter Gerlich, "Inhomogeneous RF Fields: A Versatile Tool for the Study of Processes with Slow Ions," State-Selected and State-to-State Ion-Molecule Reaction Dynamics, Part 1: Experiment , John Wiley and Sons, Inc., 1992, ISBN 0-471-53258-4, pp. 1-176.

Brown et al., "Liquid Chromatography—Electron Transfer Dissociation and Ion Mobility on a Quadrupole Time of Flight Mass Spectrometer," ASMS 2009 Poster.

* cited by examiner

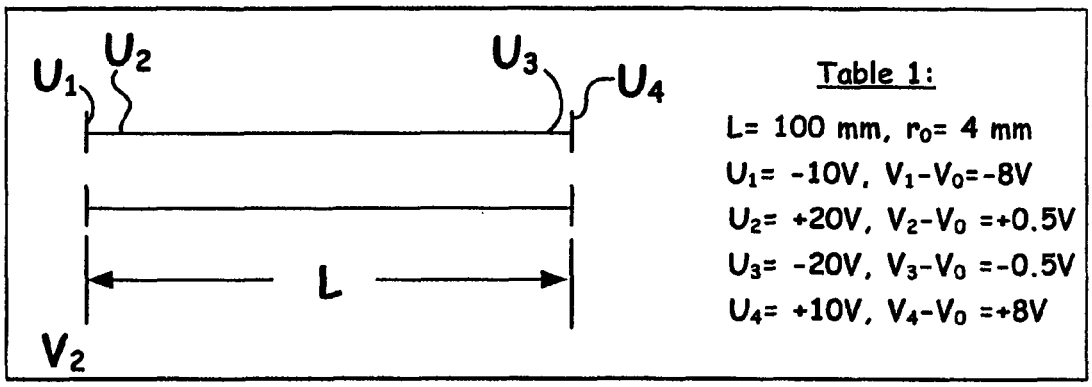
FIG. 2B
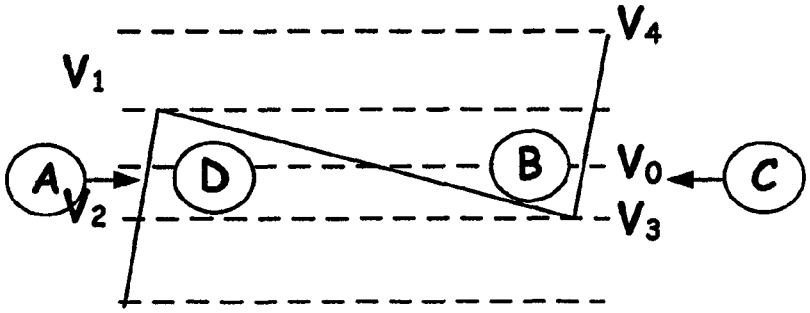
FIG. 2C
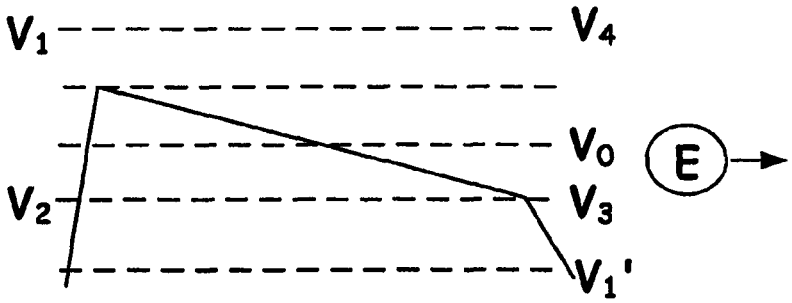
FIG. 2C'
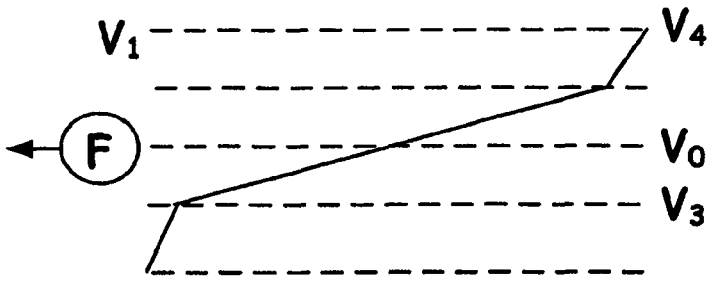
FIG. 2C"

NSPW300BS

DUAL ION TRAPPING FOR ION/ION REACTIONS IN A LINEAR RF MULTIPOLE TRAP WITH AN ADDITIONAL DC GRADIENT

BACKGROUND OF THE INVENTION

1. Field of the Invention

The present invention relates to the field of mass spectrometry, and more particularly the present invention relates to 2D linear multipole traps configured to enable ion/ion reactions, such as, but not limited to electron transfer dissociation.

2. Discussion of the Related Art

Mass spectrometry is one of the most common and most important tools in chemical analysis and became a key technique in the discovery of the electron and the isotopes. The analysis of organic compounds is especially challenging as such compounds cover a wide mass range from about 15 amu up to several hundred thousand amu, wherein the compounds themselves are often fragile and non-volatile.

In general, a mass spectrometer includes an ion source, a mass analyzer and some form of one or more detectors. As part of the function of the ion source, sample particles are ionized with techniques that can include chemical reactions, electrostatic forces, laser beams, electron beams, or other particle beams. The resultant ions are subsequently directed to one or more mass analyzers that separate the ions based on their mass-to-charge ratios. The separation can be temporal, e.g., in a time-of-flight analyzer, spatial e.g., in a magnetic sector analyzer, or in a frequency space, e.g., in ion cyclotron resonance (ICR) cells. The ions can also be separated according to their stability in a multipole ion trap or ion guide. The separated ions are detected by the aforementioned one or more detectors so as to provide data that enable the reconstruction of a resultant mass spectrum of the sample particles.

As part of the directing of the particles within a mass spectrometer, the ions are guided, trapped or analyzed using magnetic fields or electric potentials, or a combination of magnetic fields and electric potentials. For example, static electric fields are used in time of flight instruments and electrostatic traps, like the Orbitrap™, static magnetic and static electric fields are used in ICR cells, and static and dynamic multipole electric potentials are used in multipole traps such as, two-dimensional (2D) quadrupole traps or three-dimensional (3D) quadrupole ion traps. However, while a (3D) quadrupole ion trap, e.g., Paul trap, forms a true 3D trapping potential it has only a limited space charge capacity.

With respect to linear 2D multipole traps, such devices, which can be operated as collision cells, often include multipole electrode assemblies, such as quadrupole, hexapole, octapole or greater electrode assemblies that include four, six, eight or more rod electrodes, respectively. The rod electrodes are arranged in the assembly about an axis to define a channel in which the ions are confined in radial directions by a 2D multipole potential that is generated by applying radio frequency ("RF") voltages to the rod electrodes. The ions are traditionally confined axially, in the direction of the channel's axis, by DC biases applied to the rod electrodes or other electrodes such as plate lens electrodes in the trap. In a portion of the channel defined by the rod electrodes, the applied DC biases can generate electrostatic potentials that axially confine in predetermined sections of the device either positive ions or negative ions, but cannot simultaneously trap both. Additional AC voltages can be applied to the rod electrodes to excite, eject, or activate some of the trapped ions.

2-D ion guides can also include a multitude of closely spaced "stacked" ring or plate electrodes having apertures that can but not necessarily decrease in size from the entrance of the device to its exit to manipulate the ions along the induced ion channel of the configuration. Detailed background information on an example stacked ring structure can be found in U.S. Pat. No. 7,514,673, entitled Ion Transport Device," issued Apr. 7, 2009, to Senko et al. Generally described, the ring or plate electrodes are designed to have coupled oscillatory (RF) voltages with appropriate RF phase relationships to radially confine the ions. In order to provide focusing of ions to the centerline of the ion channel near the device exit, the spacing between adjacent electrodes may be increased in the direction of ion travel. The relatively greater inter-electrode spacing near the device exit provides for proportionally increased oscillatory field penetration, thereby creating a tapered field that concentrates ions to the longitudinal centerline. The magnitudes of the oscillatory voltages may be temporally varied in a scanned or stepped manner in order to optimize transmission of certain ion species or to reduce mass discrimination effects. A longitudinal DC field, which assists in propelling ions along the ion channel, may be created by applying a set of DC voltages to the electrodes.

Another exemplary type of 2D-guide comprises stacked plates or rings arranged parallel and generally transverse to the travel axis of ions (See Gerlich et al, (1992) Inhomogeneous Electrical Radio Frequency Fields: A versatile tool for the study of processes with slow ions. Adv. In Chem Phys LXXXII, 1. ISBN 0-471-53258-4, John Wiley and Sons). Generally, such structures are also arranged as radio frequency (RF) ion guides and operated under elevated pressures to efficiently transmit ions from one portion of a spectrometer to another. These devices work on the principle of so called "effective potential wells" that can trap the ions in these wells for extended periods of time either by the use of cylindrical geometry devices such as conventional Paul traps, or using linear geometry devices such as multipole guides or ring sets with end plates providing a trapping D.C. potential.

In MS/MS experiments, selected precursor ions are often first isolated or selected, and next reacted or activated to induce fragmentation to produce product ions. Mass spectra of the product ions can be measured to determine structural components of the precursor ions. Typically, the precursor ions are fragmented by collision activated dissociation ("CAD") in which the precursor ions are kinetically excited by electric fields in an ion trap that also includes a low pressure inert gas. The excited precursor ions collide with molecules of the inert gas and may fragment into product ions due to the collisions.

In a different arrangement, product ions can be produced by electron capture dissociation (ECD) or ion/ion interactions. In ECD, low energy electrons are captured by multiply charged positive precursor ions, which then may undergo fragmentation due to the electron capture. To induce ECD processes in ICR cells, the precursor ions and the electrons are radially confined by large magnetic fields, typically from about three to about nine Tesla. Axially, the positive precursor ions and the electrons are confined by electrostatic potentials in adjacent regions. Near the border of the adjacent regions, trajectories of the precursor ions and the electrons may overlap and ECD may take place. Alternatively, the trapped precursor ions may be exposed to a flux of low energy electrons. However, ECD processes are difficult to carry out in an ion trap as the applied RF fields are not conducive for receiving low energy electrons. For example, thermal electrons, if introduced into the RF fields of a RF 3D quadrupole ion trap (QIT), a quadrupole time-of-flight (TOF), or a linear RF 2D quadrupole ion trap (QLT) instrument, maintain their thermal energies for only a fraction of a microsecond and are not trapped.

Therefore, the technique remains exclusive to expensive MS instruments, such as, for example, FUR mass spectrometers.

Therefore, development of an ECD-like dissociation process for use with low cost instruments, such as a QLT, is desirable. Interestingly, electron transfer dissociation (ETD) is such a desirable alternative method for peptide dissociation by fragmenting the peptides via ion/ion chemistry using RF multipole ion trapping devices. Similar to ECD, ETD typically requires that the relative kinetic energy of the interacting particles be small, preferably less than (10, 5, 2) eV, optimally less than about 1 eV. However, ETD typically fragments the confined peptides by transferring an electron from a radical anion to a protonated peptide. This induces fragmentation of the peptide backbone, causing cleavage of the bonds just as ECD does. This creates complementary c and z-type ions instead of the typical b and y-type ions observed in CAD. Beneficially, ETD preserves post translational modifications (PTMs), such as, phosphorylations, sulfations and glycosylations that are labile by CAD and thus desirable sequence information of the peptide can be obtained.

Linear 2D multipole traps, as described above, have the desired higher capacities that can be beneficially utilized for ion/ion reactions, such as ETD, but such devices do require additional electrical fields to trap both educts simultaneously. The ion/ion reactions in linear RF multipole traps are typically induced by trapping the analytes and focusing the reactants into the trap. In such a manner, the RF pseudo potential is non-repulsive along throughout the length of the device to enable charge transfer to take place. Means of entering the trap can include parallel or perpendicular entry to the axis of the multipole. For simultaneous trapping of ions and cations, segmented traps have in the past been utilized by those skilled in the art to trap the different species in different segments with additional DC fields to predetermined segments and an added RF potential to the end lenses to enable the ion/ion reactions to take place.

To give the reader an idea of additional technical capabilities presently in the field, one is directed to background information for a system that teaches the application of a DC axial field in a RF multipole instrument, as described and claimed in U.S. Pat. No. 7,067,802, entitled, "Generation of combination of RF and axial DC electric fields in an RF-only multipole," issued Jun. 27, 2006, to Kovtoun, including the following, "[a]n RF-only multipole includes a spiral resistive path formed around each multipole rod body. RF voltages are applied to the rod body and resistive path, and DC voltages are applied to the resistive path, to create a radially confining RF field and an axial DC field that assists in propelling ions through the multipole interior along the longitudinal axis thereof. In one implementation, the resistive path takes the form of a wire of resistive material, such as nichrome, which is laid down in the groove defined between threads formed on the rod body. The RF-only multipole of the invention avoids the need to use auxiliary rods or similar supplemental structures to generate the axial DC field."

Background information on a system and method that confines positive and negative ions in a linear trap, is described and claimed in U.S. Pat. No. 7,145,139, entitled, "Confining Positive and Negative Ions With fast Oscillating Electrical Potentials," to Syka, issued Dec. 5, 2006, including the following, "[m]ethods and apparatus for trapping or guiding ions. Ions are introduced into an ion trap or ion guide. The ion trap or ion guide includes a first set of electrodes and a second set of electrodes. The first set of electrodes defines a first portion of an ion channel to trap or guide the introduced ions. Periodic voltages are applied to electrodes in the first set of electrodes to generate a first oscillating electric potential that radially confines the ions in the ion channel, and periodic voltages are applied to electrodes in the second set of electrodes to generate a second oscillating electric potential that axially confines the ions in the ion channel."

Background information on a system and method that stores ions of a first species in a linear ion trap and then subsequently transmits an oppositely charged species through the stored first species to provide for ion/ion reactions is described and claimed in U.S. Patent Application Publication No. U.S. 2008/0128611 A1, entitled, "Method and Apparatus For Transmission Mode Ion/Ion Dissociation," to McLuckey et al., issued Published Jun. 5, 2008, including the following, "[a] method and apparatus for analyzing biomolecules is described. The method includes injecting and storing one species of ionized molecule in a linear ion trap and injecting second species of oppositely polarity ionized molecule such that the second species is transmitted through the stored first species. The resultant reaction products may be analyzed by a mass analyzer taking account of the remaining charge values. In an aspect, a linear ion trap may be used as the reaction volume, and the ionized species injected along the axis of the trap in a substantially collinear manner. The mass analysis may be performed by mass selective axial ejection or by a mass spectrometer."

Background information that teaches electron transfer dissociation (ETD) in an ion trap, is described and claimed in U.S. Pat. No. 7,456,397, entitled, "Ion Fragmentation By Electron Transfer In Ion Traps," issued Nov. 25, 2008, to Hartmer et al, including the following, "[t]he invention relates to a method and instrument for the fragmentation of large molecular analyte ions, preferably biopolymer ions, by reactions between multiply charged positive analyte ions and negative reactant ions in RF quadrupole ion traps. Some of these reactions involve electron transfer reactions with subsequent dissociation of the biopolymer analyte ions, and some involve the loss of a proton, leading to stable product ions. The invention can use any type of ion traps, particularly three-dimensional RF quadrupole ion traps, for the reactions between positive and negative ions. The fragmentation yield can be increased because ions that remain stable as radical cations after transfer of an electron are further fragmented by collisionally induced fragmentation, forming fragment ions that are typical of electron transfer, and not those typical of collisionally induced fragmentation. The invention preferentially introduces positive ions and negative ions into the ion trap sequentially through the same aperture."

Additional background information that teaches electron transfer dissociation (ETD) in an ion trap, is described and claimed in U.S. Pat. No. 7,534,622 B2, entitled, "Electron Transfer Dissociation For Biopolymer Sequence Mass Spectrometer Analysis," issued May 19, 2009, to Hunt et al, including the following, "[t]he present invention relates to a new method for fragmenting ions in a mass spectrometer through the use of electron transfer dissociation, and for performing sequence analysis of peptides and proteins by mass spectrometry. In the case of peptides, the invention promotes fragmentation along the peptide backbone and makes it possible to deduce the amino acid sequence of the sample, including modified amino acid residues, through the use of an RF field device."

Accordingly, a need exists for improved methods and configurations to simultaneously confine precursor and reagent ions (i.e., cations and anions) within a RF field of multipole trapping devices so as to induce desired ion/ion reactions, in particular, ETD ion/ion reactions. The present invention is directed to such a need.

SUMMARY OF THE INVENTION

One aspect of the present invention is directed to a method of fragmenting ions that includes: introducing a population of a first group of ions and a population of a second group of ions of opposite polarity to the first group of ions into an ion channel as defined within a two-dimensional ion trap; providing along with a radially confining field, an additional static DC gradient along the axial length of said ion channel so as to axially confine within the ion channel the first group of ions in an adjacent location with respect to the second group of ions of opposite polarity; and arranging for ion/ion interactions of the introduced first group and the second group of ions to produce product ions.

Another aspect of the present invention is directed to a method of fragmenting ions that includes: introducing populations of a first group of ions and a of a second group of ions of opposite polarity to the first group of ions into an ion channel as defined within a two-dimensional multipole; providing along with a radially confining field, an additional static DC gradient along the axial length of the ion channel so as to axially confine within the ion channel the first group of ions in an adjacent location with respect to the second group of ions of opposite polarity; and arranging for the ion/ion interaction of the introduced first group and the second group of ions to produce product ions by a combination of at least two of the following steps selected from: interacting the first group of ions with the second group of ions of opposite polarity by way of diffusion; interacting the first group of ions with the second group of ions of opposite polarity by way of space charge; interacting the first group of ions with the second group of ions of opposite polarity by forcing ions through one another; interacting the first group of ions with the second group of ions of opposite polarity by changing the slope of the DC gradient; and interacting said first group of ions with said second group of ions of opposite polarity by time shifting a customized plurality of ion storage volumes.

Another aspect of the present invention provides for a mass spectrometer system that includes: at least one ion supplier to provide for a first group of ions and a second group of ions of opposite polarity to the first group of ions; a two-dimensional multipole configured to receive populations of the first group of ions and the second group of ions of opposite polarity to the first group of ions within a defined ion channel; and a controller configured to couple periodic voltages to a first set of electrodes provided by the two-dimensional multipole so as to radially confine the received first group of ions and the second group of ions of opposite polarity, and wherein the controller is additionally configured to couple an additional static DC voltage gradient along the length of the ion channel so that resultant axial forces can confine the first group of ions and the second group of ions of opposite polarity adjacent to each other within the ion channel; wherein ion/ion reactions can be arranged to produce desired product ions.

BRIEF DESCRIPTION OF THE DRAWINGS

FIG. 2B, FIG. 2C, FIG. 2C', and FIG. 2C"schematically illustrate a non-limiting example embodiment of applied voltages and resultant potentials for injection/reaction and ejection modes of operation.

DETAILED DESCRIPTION

Figure 1A:
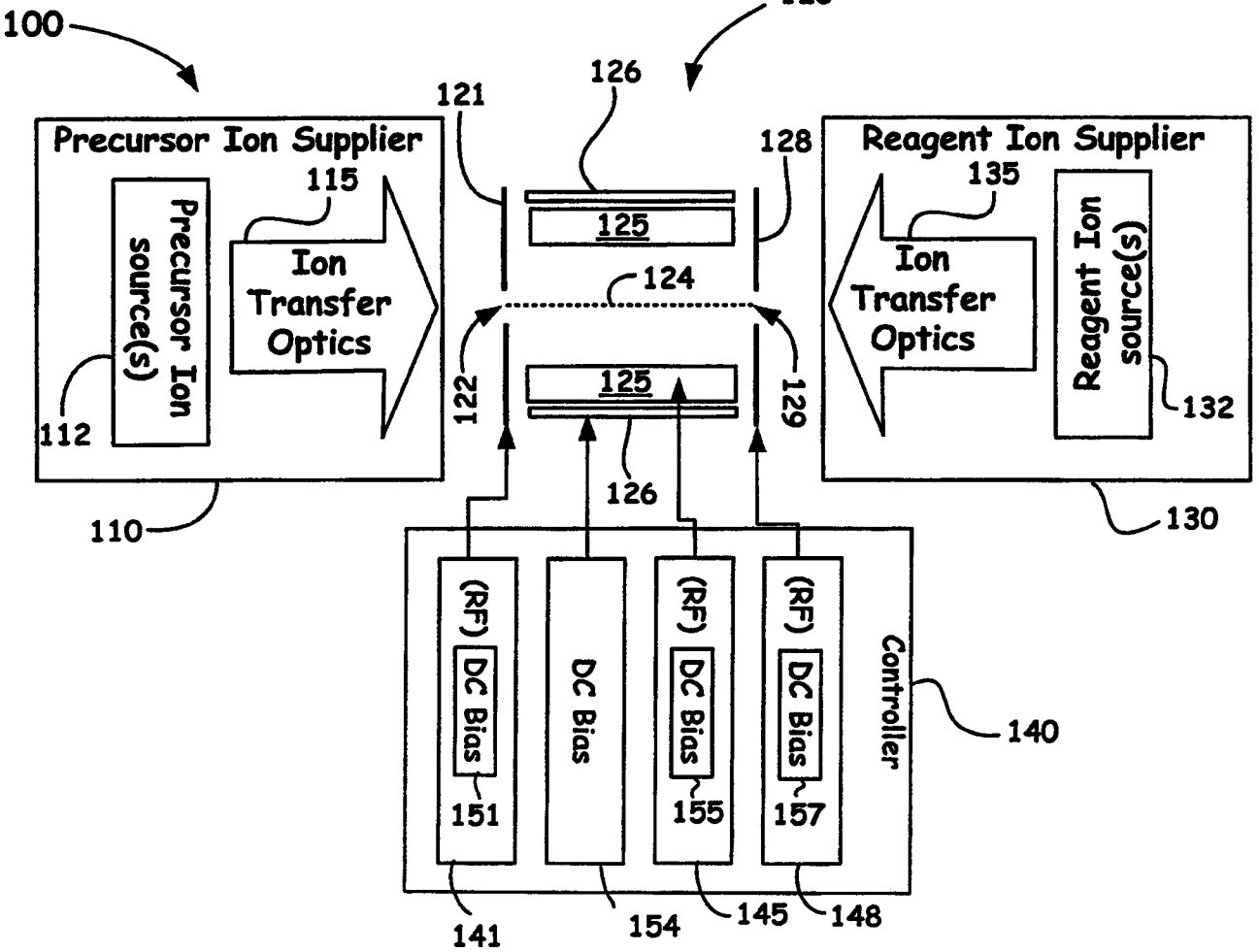
FIG. 1A shows a general schematic of a non-segmented ion trap and a coupled system to illustrate the novel concepts of the present invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. It is to be noted that as used herein, the term "adjacent" does not require immediate adjacency. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

In addition, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

A linear two-dimensional (2D) multipole ion trap, which can also operate as a collision cell, can substantially trap more positive and negative ions than a three-dimensional (3D) quadrupole trap. Thus, a 2D multipole trap is a beneficial device in detecting low abundance product ions as well as providing larger signal-to-noise ratios. As known to those skilled in the art, the RF voltages within such instruments create a pseudo-potential that is charge sign independent but requires further electrical and magnetic fields for three-dimensional trapping. As the pseudo-potential is charge sign independent, it thus provides for an ideal reaction volume for ion/ion reactions, such as, but not limited to electron transfer dissociation (ETD), which often requires the simultaneous containment of cations and anions.

The present invention is thus directed to the often simultaneous trapping of positive ions (cations) and negative ions (anions) in 2D multipole devices, e.g., 2D linear multipole traps, often 2D linear quadrupole traps as well as 2D linear traps configured as collision cells. Such techniques are aided herein by use of an additional effective DC gradient of preferably about 30 mV/cm up to about 1 V/cm so as to induce ion/ion reactions, such as, but not limited to, ETD. Additional desired instruments to be utilized herein can also include 2D linear ion traps configured as coiled double or quadruple helices. Moreover, they can be constructed as stacks of plate electrodes, having for example, a curved ion guiding region and entrance and exit regions along the same or a different axis. Finally, such 2D linear ion traps can be configured as stacked ring diaphragms, where the phases of an RF voltage are applied alternately to the ring diaphragms.

It is known that such linear 2D trapping devices, as utilized as part of a mass spectrometer system, most often incorporates four, six, eight, or more equally spaced rods often configured in a substantially spherical arrangement to enable high efficiency capture, transmission, and/or storage of desired ions. While a desired shape of the RF electrodes that make up the device(s), as disclosed herein, are often hyperbolic, it is to be appreciated that flat or circular cross sectioned rods can also be used to generate RF electric field lines similar to the theoretically ideal hyperbolic field lines between the rods without departing from the specifications of the present invention. Moreover, the ion trap can also be provided with a buffer inert gas, e.g., Helium, Neon, Argon, and most often Nitrogen to assist the ions in losing their initial kinetic energy via low energy collisions. Such provided buffer gases can be provided with pressures in the range between 1 mbar and about 0.0001 mbar, preferably around 0.01 mbar for typical peptides, including proteins, having masses between about 500 up to about 4000.

It is to be appreciated that having adjacent regions for storage of positive and negative ions is already known from FT-ICR. It is also known from FT-ICR that it is difficult to manipulate ions from such adjacent or nested trapping regions so as to introduce interaction between positive and negative ions. [e.g. Malek et al. "*Rapid. Commun. Mass Spectrom.*" VOL. 11, 1616-1618 (1997)]. However, it is surprising that so far only axial RF-trapping and "transmission mode ETD" have been demonstrated. A major contribution of the present invention is the discovery which provides operational parameters for a trap that allows migration of positive and negative ions into one another directly within substantially static axial electric fields.

As part of the design for the present invention, positive and negative ions can be easily injected at desired locations of the device, such as, for example, either a similar end or at opposite ends of the instrument, as well as from a sideways position. The positive ions can be precursor ions and the negative ions can be reagent ions or the positive ions can be reagent ions and the negative ions can be precursor ions that in either case can induce charge transfer to or from the precursor ions via ion/ion reactions. As an alternative desired reaction, negative reagent ions may abstract charged species, typically one or more protons, from the precursor ion. The charge transfer can reduce a multiple charge of the precursor ion, invert the charge polarity of the precursor ion, or induce a fragmentation of the precursor ion. Moreover, such charge transfer may induce fragmentation or simply charge reduction of ions other than the precursor ions, such as fragmentation or charge reduction of the product ions produced by prior charge transfer reactions.

In a channel where an ion population includes positive ions, negative ions or both, the ions of the present invention are radially confined by electric fields as defined by a primary RF potential of adjustable phase and/or amplitude of up to about several kilovolts with a frequency from about 500 kHz up to about 2.5 MHz applied to the alternating rods 180 degrees out of phase from each other throughout the assembly.

As known to those skilled in the art, there is typically no axial force acting on an ion on the z-axis of the quadrupole ion trap and thus it is necessary to apply an additional DC potential gradient (i.e., DC electric field) along the z-direction in order to push ions in the z-direction. In the absence of modifications, the axial DC electric potential using applied voltages from a predetermined DC supply in a linear quadrupole trap is essentially flat from the entrance to the exit of the multipole, except for a steep gradient near each end as often provided by secondary DC potential fields applied to the end lenses. Many other methods of supplying the DC trapping potential at the ends of such a 2-dimensional multipole are known, from simple diaphragms to short multipole segments or complex RF-lenses. Having such a potential is essential and frequently taken for granted but the detailed implementation is of limited influence in this case.

It is to be appreciated that the applied voltages to the gradient producing electrodes along the axis of the devices used herein are on the order of volts up to tens of volts. The result provides for potential wells formed via voltage gradients between about 0.03 V/cm up to about +1 V/cm coupled to the long axis of the linear instruments described herein. Moreover, while a smooth linear change in voltages along a length of the auxiliary electrodes is discussed, it is to be understood that other changes other than simply linear slopes may also be applied so as to confine and/or urge cations and anions along desired axial directions of the device so as to also effect ion/ion reactions such as ETD. For example, such a gradient of the present invention can also be applied in an increasing or decreasing fashion with flattened portions or even slightly reversed profiles as long as the errors are small compared to the overall design.

Such a distinct coupled additional DC offset voltage gradient(s) can be implemented often by, but not limited to, using one or more DC axial field electrodes, as known and understood in the art, which can be situated external to or integrated with or between the electrode structures that make up the multipole trapping devices described herein. To assist in the production of the coupled RF and DC fields, known components and circuitry, such as, computers, RF and one or more DC voltage supplies, RF and DC controllers, digital to analog converters (DACS), and programmable logic controllers for dynamic control of the coupled DC voltages are integrated into the present invention so as to move ions along desired directions within the apparatus described herein. Moreover, because voltage supplies required to provide the various RF and DC voltage levels are capable of being controlled via, for example, a computer, the magnitude and range of voltages may be adjusted and changed to meet the needs of a particular sample or set of target ions to be analyzed.

It is also to be appreciated that one or more ion lenses known by those of ordinary skill in the art can also be introduced to guide desired ions along a predetermined ion path. Such ion lenses can include, but are not limited to, lens stacks (not shown), inter-pole lenses, conical skimmers, gating means, (e.g., split gate lenses), etc., to cooperate with the multipole trapping devices of the present invention so as to also direct predetermined ions along either longitudinal direction and to also direct desired ions, often reacted ions to other subsequent sections and/or downstream instruments such as, for example, mass analyzers that include TOF, FTICR or different RF ion trap mass spectrometers.

Specific Description

A basis of the present invention is directed to confining predetermined ions of opposite polarity in adjacent locations with respect one another in a linear multipole using applied static DC gradients that often but not necessarily has smoothly formed potentials to provide distinct storage volumes. However, it is to be noted that when looking at the ion dynamics and applied potentials of the present invention, the ions are not, in the preferred embodiments, strictly forced to a prescribed location of the 2D linear device but are allowed to be anywhere in the trap based on probability. Thereafter, space charge can force the ions of a single charge away from another and thus increase the likelihood of them to be found in the domain of the oppositely charges ions so as to induce beneficial ion/ion reactions.

FIG. 1A illustrates an example mass spectrometer, generally designated by the reference numeral 100, configured to operate according to aspects of the present invention. While the system 100 of FIG. 1A is beneficial for illustrative purposes, it is to be understood that other alternative commercial and custom configurations having various other components can also be incorporated when using a linear 2D multipole as part of the arrangement of the present invention. As one such beneficial example, an Orbitrap™ analyzer (e.g., a Thermo Scientific LTQ Orbitrap XL™ hybrid FTMS (Fourier Transform Mass Spectrometer)) can be utilized but with the multipole collision cell of such a system configured to operate within the parameters as discussed herein.

Turning back to the drawings, the example system 100 of FIG. 1A in a basic arrangement includes a precursor ion supplier 110, a 2D multipole linear ion trap 120, a reagent ion supplier 130, and a controller 140. While the precursor ion supplier 110 and the reagent ion supplier 130 are shown as separate sources positioned at opposing ends for the production and injection of desired reactants, it is to be noted that it is also possible to generate positive and negative reactants from a single ion source so as to inject reactants at desired positions (e.g., from the same end) of the linear ion trap 120 shown in FIG. 1A. For simplicity however, FIG. 1A is used to merely illustrate the generation of precursor ions and anions from a respective single ion supplier 110 and a respective single reagent ion supplier 130 to generate ions at example end positions of the system 100.

Turning back to the discussion, the ions generated by the precursor ion supplier 110 is thus injected into a desired location of a 2D multipole linear ion trap 120, such as, for example, by injecting such ions into a first end of the 2D multipole ion trap 120 as enabled by a front aperture 122. In addition, the reagent ion supplier 130 is configured to generate ions in order to be injected into the 2D multipole ion trap 120 also from any location, but in this example discussion, injects ions from a second end, such as, for example, through back aperture 129. The 2D multipole ion trap 120 in operation thereafter provides for a channel in which the precursor ions and the reagent ions can be confined both radially and axially by oscillating and DC electric potentials coupled to the electrodes 125 as well as the end lenses 121 and 128 as generated by the controller 140.

The precursor ion supplier 110 can include one or more precursor ion sources 112 (e.g., an Electrospray Ionization Source (ESI)) to generate precursor ions from sample molecules, such as large biological molecules. While an ESI source is a beneficial provider of ions that can be coupled to the configurations of the system 100 shown in FIG. 1A, it is to be noted that other sources such as, but not limited to, an Atmospheric Pressure Ionization source (API), an electron impact (EI) ionization source, a chemical ionization (CI) source, an EI/CI combination ionization source, a thermospray ionization source, a plasma or laser desorption source, or any other source that can be utilized with the configurations described herein can also be implemented when desired. Thereafter, ion transfer optics 115 guides the generated ions from the precursor ion sources 112 to the ion trap 120. The precursor ions can be positive or negative ions and can have single or multiple charges. For example, the aforementioned ESI source often produces a large number of doubly and triply charged ions from large molecules that can lead to, for example, large numbers of ETD reactions with subsequent fragmentation of the doubly charged radical cations.

The reagent ion supplier 130 includes one or more reagent ion sources 132 to generate reagent ions from sample molecules, and ion transfer optics 135 to guide the generated ions from the reagent ion sources 132 to the ion trap 120. Upon interaction, the reagent ions may induce charge transfer from the reagent ions to other ions, such as the precursor ions generated by the precursor ion supplier 110. In particular, the reagent ions can induce proton transfer or electron transfer to or from the precursor ions.

The choice of the particular reagent ions depends on the precursor ions and/or parameters of the ion trap. For positive precursor ions, the reagent ions can include any molecule that possesses a positive electron affinity (EA) (reacts exothermically to form a stable or meta stable radical anion) and thus can function as an electron donor so as to have the potential to be used as a reagent in the ion/ion dissociation reaction. In addition, it has been determined that other compounds that form even-electron species can transfer an electron when reacted with multiply charged peptides so as to operate as an anion. A list of such capable reagent anions that can be utilized herein are described in U.S. Pat. No. 7,534,622 B2, entitled, "Electron Transfer Dissociation For Biopolymer Sequence Mass Spectrometer Analysis," issued May 19, 2009, to Hunt et al, the disclosure of which is herein incorporated by reference in its entirety.

For negative precursor ions, the reagent gas phase ions are positive ions, such as, He, Ne, Xe, Ar, N2+, O2+, CO+, or any other radical cations that can abstract an electron from a polypeptide anion. With respect to positive precursor ions, the reagent ion sources 132 can be configured to generate negative reagent ions using for example, similar sources as described above for the precursor ion supplier 110. For example, with respect to a chemical ionization CI source, negative reagent ions can be generated by associative or dissociative processes in a chemical plasma that includes neutral particles as well as positively and negatively charged particles, such as, ions or electrons. In the chemical plasma, low energy electrons may be captured by neutral particles to form a negative ion. The negative ion may be stable or may fragment into product ions that include negative ions. The negative reagent ions can be extracted from the chemical plasma, for example, by electrostatic fields. In alternative implementations, the reagent ion sources 132 generate the reagent ions using other techniques. For example, positive and negative ions can be generated by ESI, and once again the negative reagent ions can be directed using electric and magnetic fields.

The ion transfer optics 115, 135 transport the ions generated by the precursor ion sources 112 and the reagent sources 132, respectively, to the multipole ion trap 120. The ion transfer optics 115 or 135 can include one or more 2D multipole rod assemblies such as quadrupole, octapole or a higher number of rod assemblies to confine the transported ions radially in a channel. The ions can be transported between different rod assemblies by, for example, inter-multipole lenses. The ion transfer optics 115 or 135 can be configured to transport only positive or negative ions or to select ions with particular ranges of mass-to-charge ratios. The ion transfer optics 115 or 135 can also include lenses, ion tunnels, lens stacks (not shown), inter-pole lenses, conical skimmers, gating means, (e.g., split gate lenses), plates, rods, etc. to accelerate or decelerate the transported ions. Optionally, the ion transfer optics 115 or 135 can include ion traps to temporarily store the transported ions.

The multipole ion trap 120 often includes a front plate lens 121, a back plate lens 128 wherein the front lens 121 is configured to provide the front aperture 122 to receive and manipulate the ions transported by the ion transfer optics 115 from the precursor ion sources 112. Correspondingly, the back lens 128 is configured to provide a back aperture 129 to receive and manipulate the ions transported by the ion transfer optics 135 from the reagent ion sources 132.

As part of the manipulation process, the lenses 121 and 128 can be configured to prevent desired ions coming close to such lenses from passing. For example, lens 121 of FIG. 1A can be provided with a DC potential via DC bias 151 to prevent cations from exiting while lens 128 of FIG. 1A can be set with a DC potential via DC bias 157 to prevent anions close to that lens from exiting. The controller 140 is also configured to couple a DC bias 155 to the electrode assembly 125 of the multipole ion trap 120 as well as a DC bias 154 to provide the additional static DC gradient of the present invention. Moreover, the controller is configured to apply RF voltages 141 and 148 to the front 121 and back lenses 128 having different frequencies or phases from the frequencies or phases of the sets of RF voltages 145 coupled to the rod assemblies 125. While not preferred in the present invention, the RF voltages 141 and 148 coupled to the front lens 121 and the back lens 128 can nonetheless be used if desired to generate oscillating electric potentials that can also simultaneously confine positive and negative ions in the axial direction at the corresponding end of the channel about the axis 124. Axially confining ions with oscillating electric potentials is detailed in U.S. Pat. No. 7,145,139, entitled, "Confining Positive and Negative Ions With fast Oscillating Electrical Potentials," to Syka, issued Dec. 5, 2006, the disclosure of which is herein incorporated by reference in its entirety, and thus will not be discussed in detail herein.

It is to be noted that while the system of FIG. 1A is shown with respect to a non-segmented trap, it is to also be noted that the methods, as disclosed herein, can also be applied using segmented traps, such as, but not limited to, a commercial ThermoFisher LTQ Three Section RF Linear Quadrupole Trap.

Figure 1B:
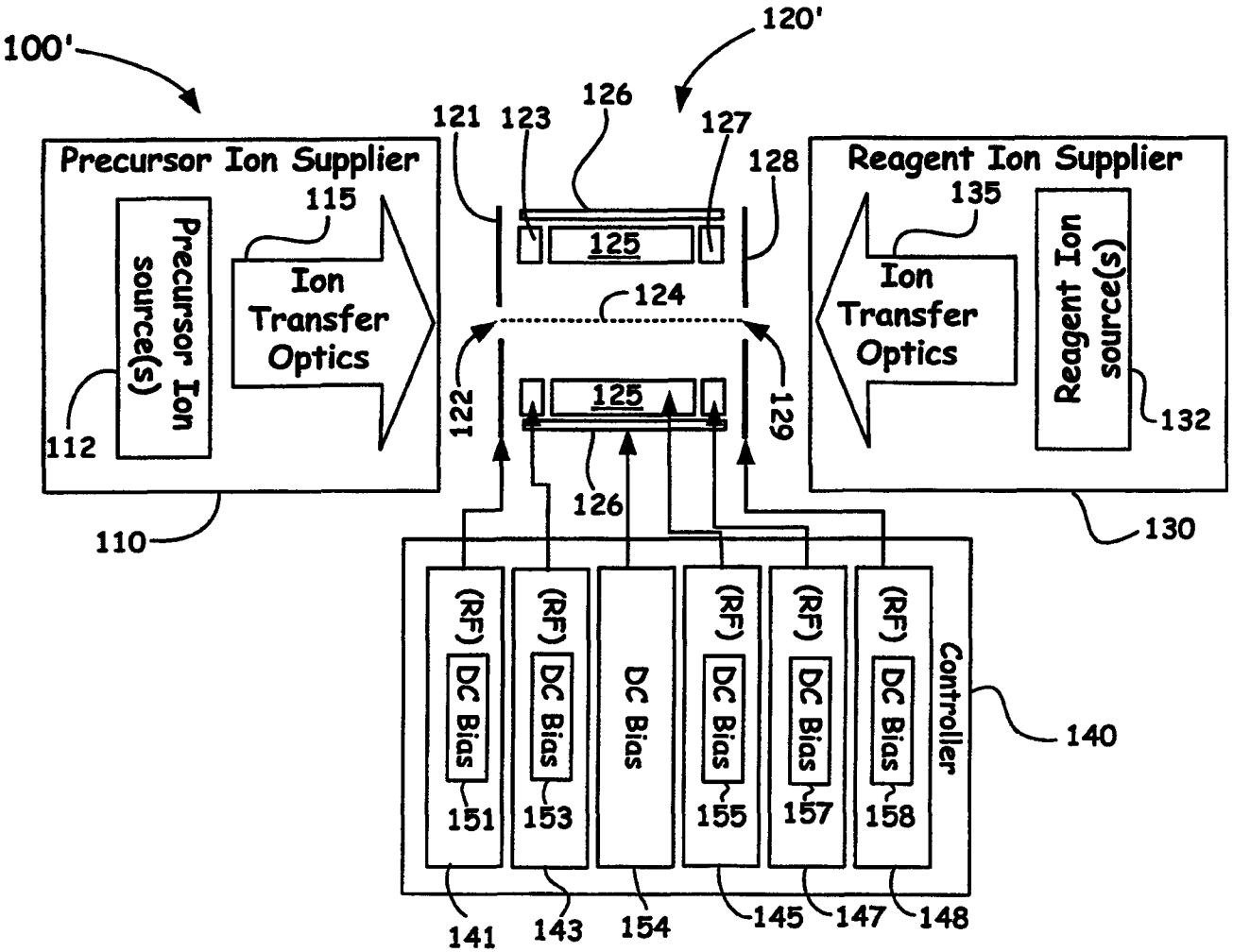
FIG. 1B shows a general schematic of a segmented ion trap and a coupled system to illustrate the novel concepts of the present invention.

FIG. 1B shows such an example arrangement, now generally designated by the reference numeral 100', with like numerals and descriptions incorporated for similar components that are similarly shown in FIG. 1A. The ion transfer optics 115, 135 again can similarly transport the ions generated by the precursor ion sources 112 and the reagent sources 132, respectively, to the multipole ion trap now designated as 120'. The multipole ion trap 120' of FIG. 1B can include a front plate lens 121, a back plate lens 128 wherein the front lens 121 is configured to provide the front aperture 122 to receive and further manipulate the ions transported by the ion transfer optics 115 from the precursor ion sources 112, and wherein the back lens 128 is configured to provide a back aperture 129 to receive and further manipulate the ions transported by the ion transfer optics 135 from the reagent ion sources 132. For the segmented ion trap 120' of FIG. 1B, each of the sections 123, 125 and 127 includes a corresponding 2D multipole rod assembly, such as, but not limited to, a quadrupole rod assembly having four quadrupole rod electrodes. Each of the multipole rod assemblies defines a portion of a channel about the longitudinal axis 124 of the ion trap 120'. In such a channel, ions can be radially and axially confined in one or more of the sections 123, 125, 127 by oscillating electric potentials generated by the voltages applied to the multipole rod electrodes and the lenses 121 and 128 of the ion trap 120.

The controller 140 of FIG. 1B often can couple, if desired, a corresponding set of RF voltages 143, 145, and 147, to the multipole rod assemblies in the sections 123, 125, and 127, to generate oscillating 2D multipole potentials that confine ions in radial directions in the channel about the axis 124. In particular, the controller 140 often can couple a primary set of RF voltages of adjustable phase and/or amplitude to the alternating rods 180 degrees out of phase from each other in the sections 123, 125, and 127.

The controller 140 can also be configured to apply different DC biases 151, 153, 155, 157, and 158 to the lenses and rod assemblies in different sections of the ion trap 120' so as to aid the novel additionally coupled DC gradients of the present invention. Depending on the sign of the DC bias applied in a section of the trap 120, positive or negative ions can be axially confined in a predetermined section. For example, positive precursor ions can be trapped in the front section 123 by coupling a negative DC bias to the multipole rods in the front section 123 and substantially a zero DC bias to the center section 125 and the front lens 121. Similarly, negative reagent ions can be trapped in the back section 127 by coupling a positive DC bias to the multipole rods in the back section 127 and substantially a zero DC bias to the center section 125 and the back lens 121. By coupling different DC biases to different segments and lenses, the positive and negative ions can be received or separated in the ion trap 120' in a predetermined manner and then further manipulated by the additional DC gradient of the present invention. The controller 140 can also couple additional AC voltages to the electrodes in the ion trap to eject ions (e.g., using resonance ejection) from the ion trap 120' based on the ions' mass-to-charge ratios.

In particular, using FIG. 1A for illustration purposes, the progressively increasing or decreasing static DC gradient can be applied along the length of a multipole device using the electrode arrangement 126, as further discussed below, at substantially the same time frame as the ions are directed into the multipole ion trap 120'. Because the DC gradient can be controlled via, for example controller 140, the present invention enables a coupled progressively increasing or decreasing static DC gradient or variant thereof along the length of the device that can also be switched (e.g., from a progressively increasing to a progressively decreasing DC gradient or variant thereof with respect to the input side) to enhance beneficial ion/ion processes (e.g., ETD) to take place within the internal volume of the device. Moreover, the additional DC potential gradient is in electrical cooperation with any of the other RF and DC potentials applied during operation of linear RF 2D multipoles that also enable trapping, isolating, parking, and or ejecting of desired ion species.

It is to be appreciated that there are various configurations that can provide DC axial fields to the linear 2D ion multipoles of the present invention. For example, such configurations can include, providing a set of conductive metal bands spaced along each rod with a resistive coating between the bands, providing resistive coatings to tube structures, resistive or coated auxiliary electrodes, curved thin plates contoured to match the curvature of the electrode set structures, and/or other means known to one of ordinary skill in the art to move ions via induced DC axial forces along desired ion paths (see for example U.S. Pat. No. 5,847,386 and U.S. Pat. No. 7,067,802). The point to be made is that regardless of how the additional DC voltage gradient is formed, the resultant voltages are desired to form a range of voltages, often a range of progressive voltages so as to create a voltage gradient along the long axis of the devices described herein so as to form potential wells that enable the desired reactions to take effect.

Figure 2A:
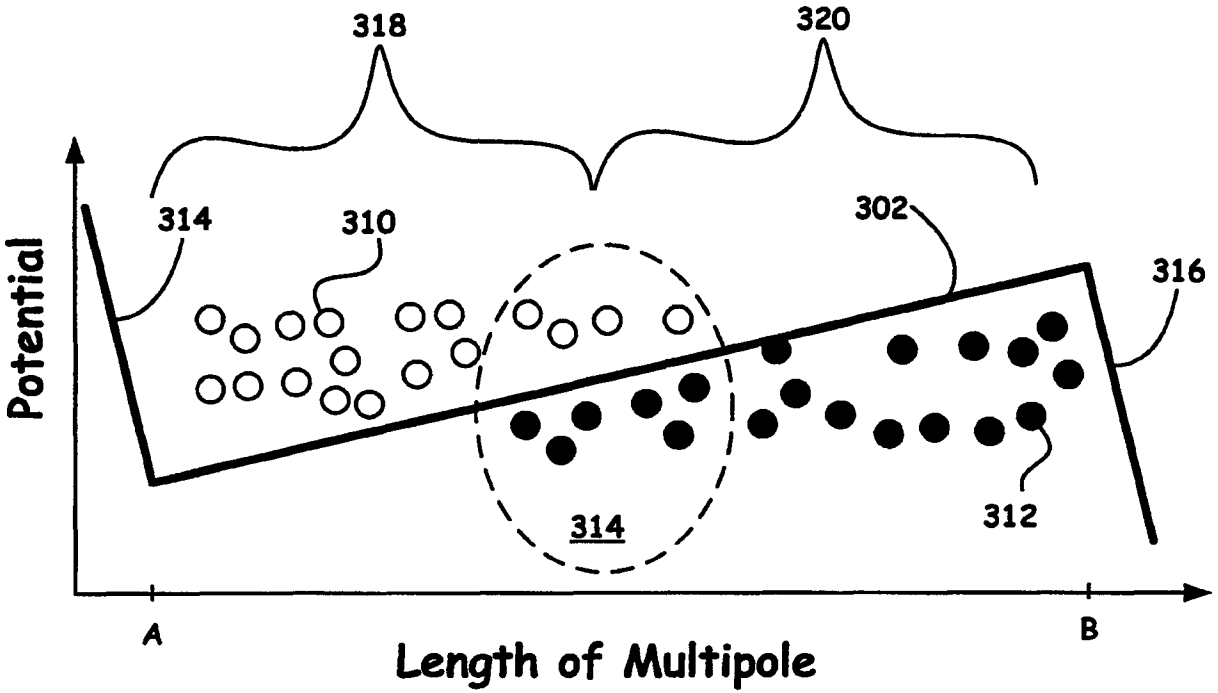
FIG. 2A schematically shows a Z-type potential formed along the long axis of a multipole so as to illustrate the principles of the present invention.

FIG. 2A illustrates an example application of the DC potential gradient 302 that can be applied along the long axis of a multipole described herein. The regions 314 and 316 shown in FIG. 2A are external to the multipole device and are configured with potentials maintained to prevent desired ions 310 and 312 from exiting. In region 320 within the multipole, the potential is lower at point A with respect to region 314 and is shown to progressively increase up to a potential at point B which is of a higher potential with respect to external region 316. Such applied potentials provide for formed potential barriers. Within the resultant Z-shaped potential 302, 314, and 316 in FIG. 2A, there is a certain range of overlap 314 (as denoted by those within the dashed ellipse) between the negative 312 (dark circles) and positive 310 (light circles) ion populations by manipulating the slope of the potential gradient 302 in addition to other effects as discussed hereinafter.

Generally, ions can move at their energy freely and where the ions can get depends on: the temperature (the equilibrium kinetic energy of ions is kT (about 0.03 eV at room temperature), which defines how much the ions can "climb" upwards along the gradient 302; the pressure (or more accurately the mean free path L of the ions), which defines when they have the next chance to gain kinetic energy from collision with a neutral; and the slope of the gradient (which defines how well the ions are confined within their respective potential wells).

Accordingly, the relevant figure is kT/L for the present invention is when the (average) slope of the gradient along the trap is somewhere in the range from about kT/L (or kT/2 or so) to several kT/L (i.e., a preferred DC gradient of about 30 mV/cm, but also up to about 1 V/cm when required) so that the ions are able to move more or less freely along the gradient and react with ions of the opposite polarity. The ions are moving and for every collision with a background gas molecule when operated at beneficial pressures of between about 0.001 mbar down to about 0.0005, i.e., having a mean free path of about 1 cm for mass (m)=1000 in Nitrogen at about 1E-2 mbar, they receive another chance of being driven towards an ion with opposite charge. The typical model here is a random walk due to their thermal energies alone, and (e.g. looking at positive ions 310) the reaction probability basically depends on the ratio of ions moving right after a collision to the ratio of ions moving left. For a zero gradient the probabilities are equal (e.g., the situation in a 3-D trap or in a 2-D trap with RF-lenses and no gradient). When more ions are filled into one of the reservoirs space charge expands the cloud, driving the ions "upward" in energy, also towards the other ions, increasing the reaction probability further.

Beneficial Injection Mode of Operation

A beneficial example injection embodiment of the present invention includes injecting positive ions 310 through either of the front and back apertures 122 and 129 of a configured trap 120, as shown by the example arrangement of FIG. 1A and then trapping the positive ions 310 in the left trapping volume location 318 using any of well known techniques known to those skilled in the art. Next, negative ions 312 can be injected, for example, from the left side at the energy level shown in FIG. 2A so that they have to pass through the prior positive ion 310 population. Upon injection, the negative ions 312 lose energy through collisions and eventually settle in the other (right) ion storage zone 320. During transport, possible with a few reflections, the negative ions 312 passing through the cloud of previously injected positive ions 310 helps to optimize reaction times. Thereafter ions 310 and 312 can continue to react by way of diffusion so as to provide beneficial reactants that can be further directed to a mass analyzer upon ejection.

Example Applied Voltages and Potentials

FIG. 2B, FIG. 2C, FIG. 2C', and FIG. 2C"schematically illustrate a non-limiting example embodiment using example applied voltages and resultant potentials to illustrate a possible injection/reaction and subsequent ejection modes of operation of the present invention. As shown in FIG. 2B, an example 2D linear trap of the present invention includes a device having a length L of about 100 mm with $r_0$ given as 4 mm (as also provided in Table 1 of FIG. 2B). Also shown are denoted applied potentials, as denoted by $U_1$, $U_2$, $U_3$, and $U_4$ at approximately the positions shown along the device. Table 1 gives the applied voltages along the length of the device to provide for such potentials. Below the example 2D linear trap as shown in FIG. 2B are three plots (shown not to scale) FIG. 2C, FIG. 2C', and FIG. 2C" of applied voltage profiles $V_1$, $V_2$, $V_3$, and $V_4$ that result in the applied potentials configured for injection (plot shown in FIG. 2C) and ejection (FIG. 2C', and FIG. 2C"). The difference in applied voltages, i.e., $V_3-V_0$ and $V_3-V_0$ as shown in Table 1 indicate the example applied gradients.

Accordingly, FIG. 2C shows an example mode of injection wherein positive ions can be injected at the end indicated as position A (also denoted with a directional arrow) using techniques discussed herein. Position B, as shown in FIG. 2C indicates the storage location of such positive ions as provided by the potential minima provided by $U_3$. Position C (also denoted with a directional arrow) indicates the end location that negative ions can be simultaneously injected so as to pass through the ion could of positive ions before being stored in the potential minima $U_2$ location as indicated by the position denoted as D. As described above, during transport, the negative ions passing through the cloud of previously injected positive ions helps to optimize reaction times and upon storage in indicated locations, continue to react by way of diffusion and/or space charge effects and/or changing of the applied voltages so as to change the slope of the gradient and/or even reversing the gradient. It also to be noted that injection from opposite sides can also work by switching of voltages at the end points, i.e., $V_1$ and $V_4$ using techniques understood by those skilled in the art.

FIG. 2C' and FIG. 2C"each illustrate non-limiting example ejection modes of operation by reconfiguring the potentials after mixing of desired ions. The general purpose is to apply a smooth potential gradient with a slope along the length of the trapping volume (e.g., greater than about 30 mV/cm) to ensure that the ions within the device exits in a timely manner.

FIG. 2C' thus shows a change in the potential at one end using an applied voltage denoted as $V_1$', which is equal to $V_1$ (i.e., −8V), as opposed to the initially applied voltage $V_4$ (i.e., +8V). Such a mode of operation enables the ejection of reaction products at the end of the device as indicated at position E and the accompanying directional arrow. It is to be noted that the operations shown for ejection of reaction products can also be reversed by switching potentials in known ways.

As an alternative, FIG. 2C" shows another example ejection mode of operation by configuring the applied voltages to provide potentials as shown FIG. 2C" after mixing of desired ions using the potentials provided in FIG. 2C. In this mode of ejection positive ions as well as the adduct ions are directed to the end indicated at F as also shown with an accompanying directional arrow.

Further Discussion of Example Modes of Operation

It is to be first noted that all like reference numerals are used hereinafter where similar to earlier descriptions. Applied example potentials are not shown for simplicity. As a general principle of operation using the illustration of FIG. 3A as a guide, precursor cations 310 (denoted as light circles) and reagent anions 312 (denoted as dark circles) can be first injected from any end of the ion trap 120 device, such as, for example, through front and back apertures 122 and 129 respectively, of a configured non-segmented ion trap 120, as shown by the example arrangement of FIG. 1A. Correspondingly, both sets of ions, 310 and 312, can be simultaneously trapped in adjacent but somewhat overlapping locations 314 about reference points A and B by application of an additional static DC gradient 302. Lenses (e.g., the example lenses 121 and 128 of FIG. 1A) are also configured to prevent desired ions coming close to such lenses from passing. For example, lens 121 of FIG. 1A can be provided with a DC potential via DC bias 151 to enable region 316 and prevent cations from exiting while lens 128 of FIG. 1A can be set with a DC potential via DC bias 157 to enable region 318 and prevent anions close to that lens from exiting.

The beneficial desired aspect is that for both ion populations, there are potential minima in vicinities along the multipole. If larger ion populations are subsequently injected into the multipole, the resultant space charge (i.e., coulomb repulsion) manipulates the ions to move uphill their respective gradient towards the center of the multipole 314. In particular, the increase in space charge forces the ions of a single charge (e.g., anions 312) away from another and thus increase the likelihood of them to be found in the domain of the oppositely charge ions (e.g., cations 310).

Figure 3A:
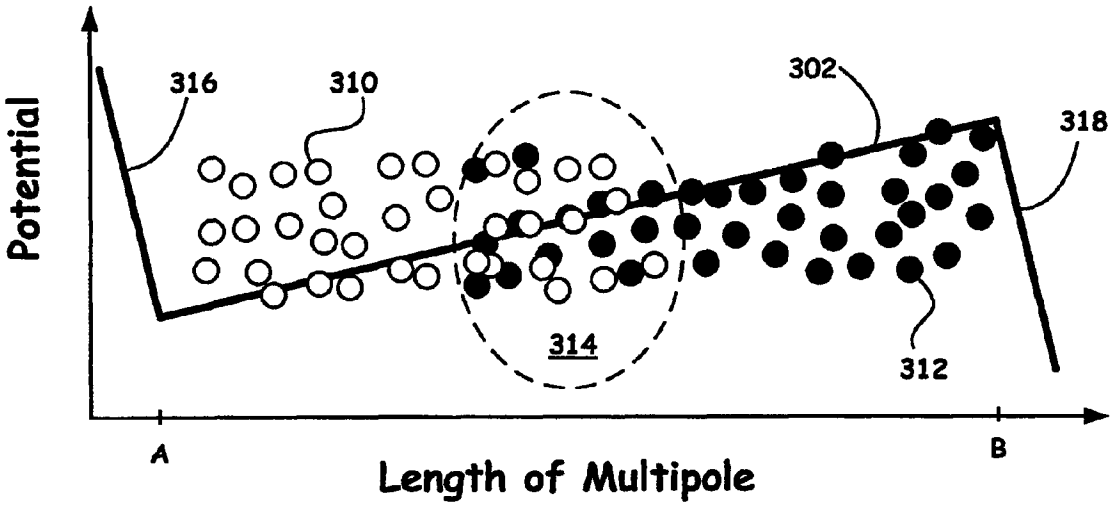
FIG. 3A schematically illustrates resultant space charge effects after further cation and anion injection to force the oppositely charged ions uphill their respective gradient so as to move towards the center of the multipole and induce desired ion/ion reactions.

FIG. 3A thus shows the trapped cations 310 and anions 312 mixing in a location 314 (as shown within the dashed ellipse) in a controlled manner so as to enable ion/ion reactions to take place. While the present invention generally profits from smooth potentials, it is to be noted that the DC gradient need not necessarily be linear and can take on the shape of different potentials using configurations disclosed herein. Such an application enhances the possibility of overlapping the introduced oppositely charged ions so as to improve desired reactions. The desired effect is that because such ions are being confined in the same portion of the channel, the precursor and reagent ions interact with each other so that charge may be transferred from the reagent ions to the precursor ions. Beneficially, the charge transfer may induce charge reduction of a multiply charged precursor ion or even a charge reversal of the precursor ions. The charge transfer may also have an energy that dissociates the precursor ions into two or more fragments. Such ion/ion reactions can thereafter be stopped at any time by, for example, segregating the positive and negative ions via a change in the applied DC potential gradient.

In operation using a segmented ion trap, as shown in FIG. 1B, the cations 310 can also be first injected from any end, often the front end through aperture 122 of FIG. 1B of the segmented ion trap 120' device (also generally referenced by point A in FIG. 3A). After injection, such cations 310 are capable of being induced to accumulate, if desired, at about the center portion 314, as generally shown in FIG. 3A, of the instrument using applied RF pseudo-potentials and applied segmented DC fields as known in the art. In this mode of operation, a desired ion species (e.g., precursor ions) can be selected and isolated via ejection (often radial ejection) of all undesired positive ion species that are not within a desired m/z window.

The selected cation species 310, as shown in FIG. 3A, can then be urged to a desired location of the multipole device via the applied DC potential gradient 302 (shown as a solid line) alone or in combination with the aforementioned segmented DC fields. Anions 312 (denoted as light circles) can then be injected from the opposite end (e.g., through aperture 129 of lens 128, as shown in FIG. 1B) of the device using known techniques and also if desired, the RF potentials, DC potentials and the applied DC gradient can be configured so that desired anions can also be isolated and selected as similarly implemented for the positive cations 310. The applied segmented DC potentials as well as the additional configured DC gradient can be reconfigured thereafter so that desired oppositely charged cation 310 and anion 312 (denoted as dark circles) particles are adjacently positioned locations along the axis of the multipole device with some overlap for desired overlapping charge separation prior to ion/ion/mixing. As before, configured end lenses at both ends of the multipole can be positioned to stop ions near the end points from passing. As part of the operation, the DC segmented fields can be removed leaving only a desired DC gradient field.

Thereafter, if the disposed ions are large enough in population and the DC potential enables movement of the ions, the resultant space charge can move the ions from the opposite ends uphill the gradient towards the center of the multipole, as similarly discussed for the non-segmented ion trap. As a result of this arrangement, the cations and anions are forced in a proper energetic manner to meet substantially in the center portion of the multipole instrument so as to enable desired ion/ion reactions (e.g., ETD) to take place as previously described. Such ion/ion reactions can thereafter be stopped at any time by again segregating the positive and negative ions via a desired DC potential gradient applied to the segments alone or in combination with a predetermined additional DC field gradient of the present invention.

Static Trapping

Figure 3B:
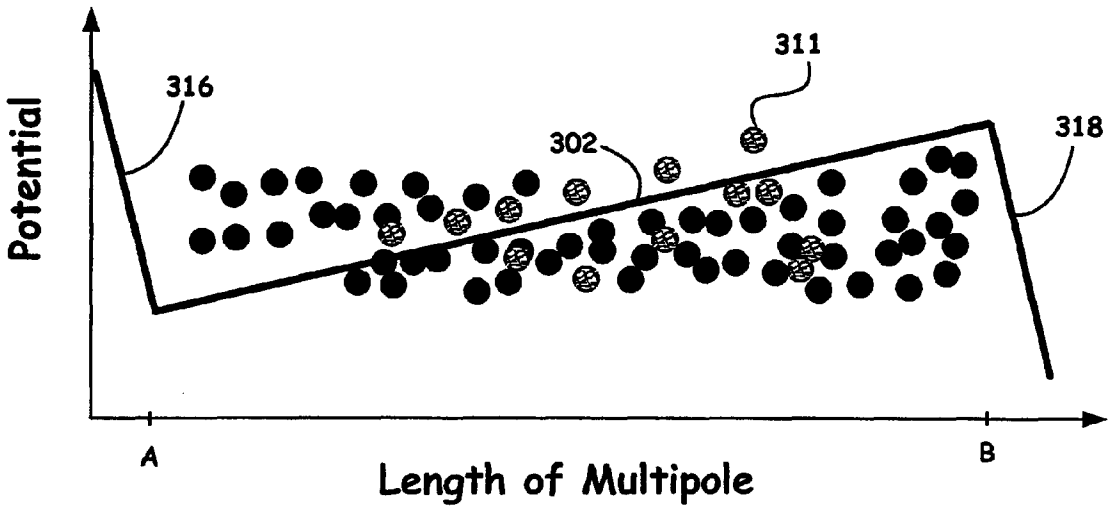
FIG. 3B schematically illustrates a static-trapping method via injection of larger populations of anions until the space charge limit is reached.

FIG. 3B illustrates a static example trapping method of operation using the linear RF multipoles, as discussed above. Within the confines of, for example, an ion trap 120, as shown in FIG. 1A, cations 310 and anions 312 can be injected from opposite ends, as similarly discussed above, and trapped in configured storage volumes having overlap in the central region of the device. The trapping of such oppositely charged ions includes the coupled DC gradient 302 in combination with the stopping potentials provided by the end lenses (e.g., lenses 121 and 129 of FIG. 1A), as discussed above. In this example embodiment, anion 312 injection continues until the space charge limit is reached, thus inducing the anions 312 to exit the ion trap through the opposing side (e.g., reference point A, as shown in FIG. 3B) while also providing desired ion/ion reactions because of interactions with trapped cations (not shown here for simplicity) positioned substantially at the opposite end of the multipole. During injection, trapping and ion reaction, applied potentials are often kept constant. After ion/ion reactions stop, the product ions 311 (now denoted as patterned circles) can be ejected through, for example, one of the entrance lenses (e.g., lens 128 of FIG. 1A and as also generally shown by the reference point B in FIG. 3B) using known methods and components understood by those skilled in the art.

Repeated Static Trapping

As another example embodiment of the static trapping discussion above, it is to be appreciated that during the ion/ion reactions, electrical charges are neutralized. In this case, even if an ion trap 120 of FIG. 1A is filled to the space charge limit at the beginning of the reaction it is not at its end. As discussed above, because all applied potentials are often kept constant during injection and trapping, either ion population (i.e., cations 310 and anions 312) can be increased by repeated injections during the ion reaction. Because of such an implementation, this mode of operation increases yield of the product ions 311, as shown in FIG. 3B, for a single scan.

Semi-static Trapping

Figure 4A:
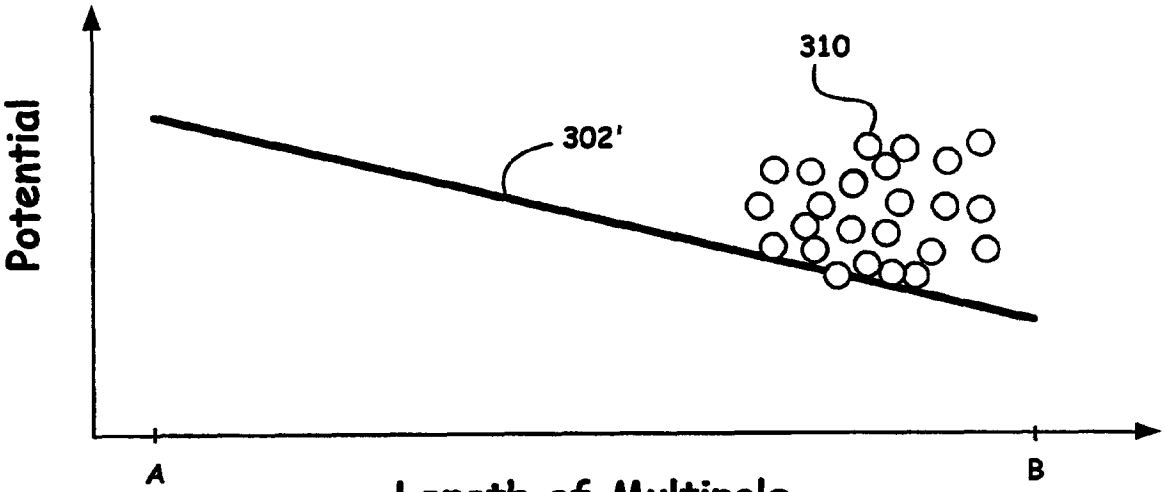
FIG. 4A schematically illustrates a semi-static trapping embodiment.
Figure 4B:
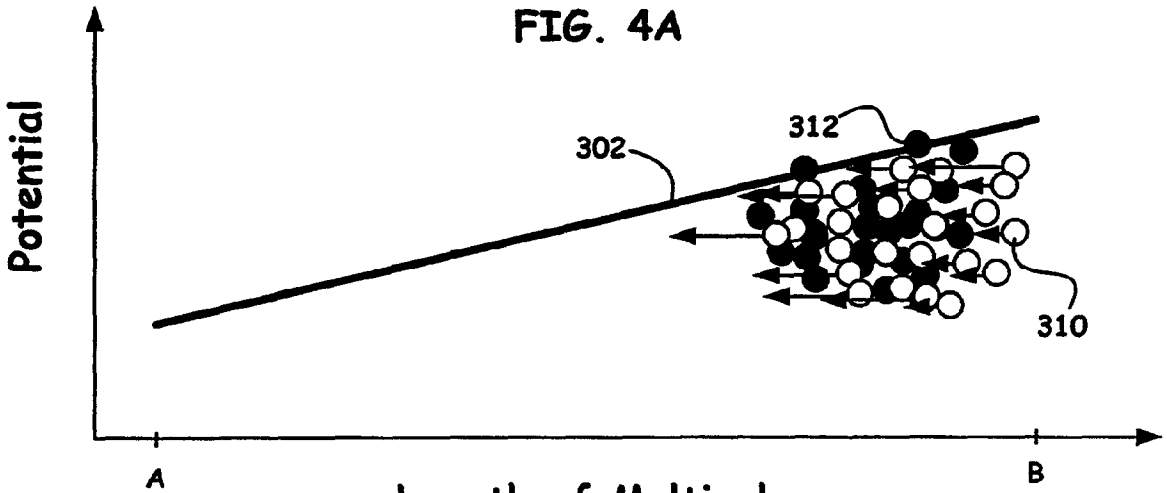
FIG. 4B schematically illustrates the semi-static trapping arrangement after cation injection has stopped and the gradient is switched to start the cations moving through newly injected trapped anions.

FIG. 4A and FIG. 4B illustrates a variation of the static trapping embodiment, (i.e., a semi-static trapping arrangement), wherein cations 310 are capable of being injected at an entry point (e.g., point A or point B) using a desired gradient 302' designed to store such ions in a storage volume location configured along the length of the device (e.g., point B). Speaking solely of cations 310 injected at the opposite end (point A), such ions are directed along the length of the device (e.g., multipole 120 of FIG. 1A) and trapped at the desired storage volume location shown generally at point B of FIG. 4A as determined by the slope of the applied gradient, buffer gas pressure and the equilibrium kinetic energy (kT) of initially injected cations 310. End stopping potentials are not shown for simplicity. After cation 310 injection has stopped, the gradient 302 is switched, as now generally shown in FIG. 4B, and the cations 310 start moving through the device (some of the cations 312 are shown with accompanying directional arrows for movement effect). The lens closest to the cations (e.g., the lens near reference point B) can now be switched for anion 312 injection as the moving cations 310 are no longer affected. For a short period of time, the cations 310 are at the minimum potential of the anions. This method of operation enables the cations to be forced through trapped anions 312.

While not explicitly illustrated, such a mode of operation can equally be applied with anions 312 instead being first injected at an entry point (e.g., point B) with a reversed gradient and trapped at the opposite end (e.g., point A). In this mode, however, after anion 312 injection has stopped, the gradient 302 is switched and now the anions 312 start moving through the device (not shown). Once again, the lens closest to the anions 312 can be appropriately switched for cation 310 injection as the moving anions 312 are no longer affected. In this example, the anions 312 are at the minimum potential of the cations 310. However, this method of operation now enables the anions 312 to move through trapped cations 310.

Figure 5A:
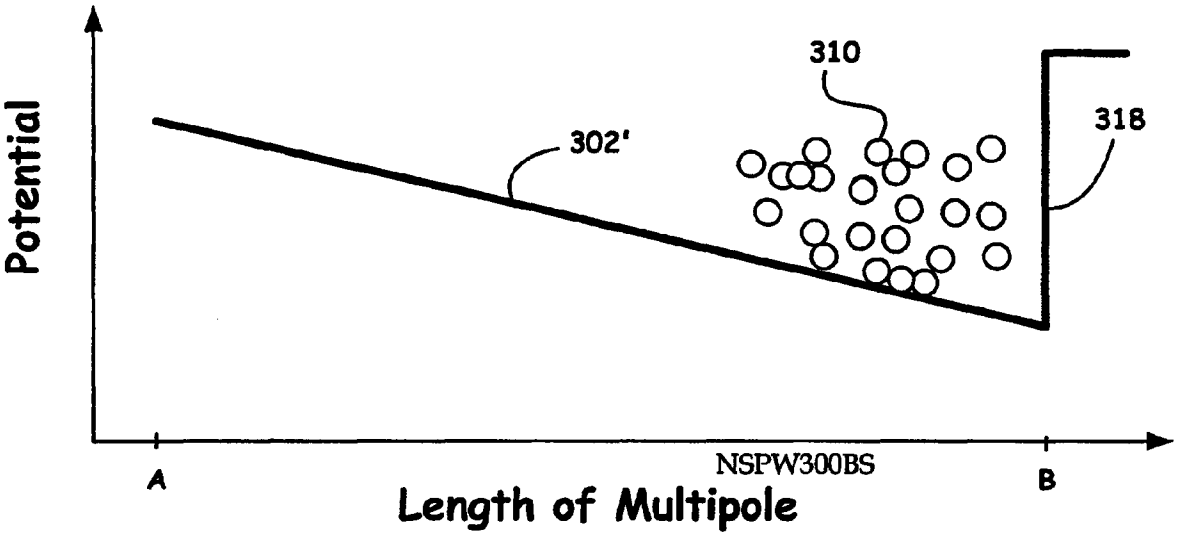
FIGS. 5A and 5B illustrate a beneficial mode embodiment that combines the passing mode, similar to the discussion above with respect to FIGS. 4A and 4B, in combination with the preferred static mode.
Figure 5B:
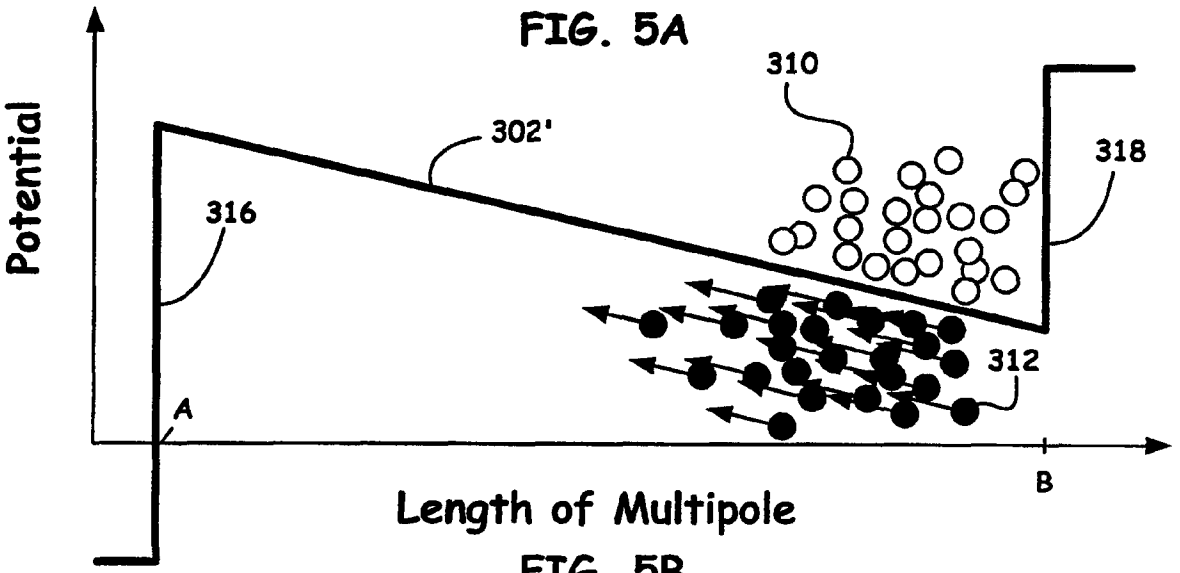

FIGS. 5A and 5B illustrate a beneficial embodiment that entails the advantages of the potential mode of passing ions through ions of opposite polarity, similar to the discussion above with respect to FIGS. 4A and 4B, in combination with the static mode of operation. Thus, cations 310 can be injected at an entry point (e.g., point A) with a reversed gradient 302' and an example stopping potential 318 at the opposing end so as to be trapped at a predetermined location (generally shown adjacent reference point B in FIG. 5A) as determined by the slope of the applied gradient, buffer gas pressure and the equilibrium kinetic energy of initially injected cations 310. After cation 310 injection has stopped, the lens closest to the cations (e.g., the lens adjacent to reference point B) is switched for anion 312 introduction. As shown in FIG. 5B, because the anions 312 (directional arrows coupled to anions 312 approximate slope of gradient 302' so as to illustrate operation) are injected at a higher relative energy (note the Y-axis denotes potential not position), they pass through trapped cations 310 to aid in optimizing the reaction times and follow the slope of the gradient 302'. The anions 312 are thus directed to the opposing end as determined by the slope of the applied gradient, buffer gas pressure and the equilibrium kinetic energy (kT). Upon reflection (e.g., as induced by stopping potential 316) the anions 302' can react (e.g., via diffusion) in the preferred static mode (with a differential energy (dE)=0), as described in the present invention.

Reaction Control by Ion Mobility

As yet another embodiment, semi-static trapping can also be used to separate different species, such as, product and educt by ion mobility. If, for example, anion injection is delayed compared to the reversing of the trapping potential, the faster ions, such as the cations illustrated in FIGS. 4A and 4B, have already left the zone of high anion density. Therefore, the spatial overlap between anions and slow cations is increased and the reaction between such species is enhanced.

Ion Compression by Pulsed Lens Potentials

As part of the design of the present invention, simultaneous trapping is realized by charge separation having overlap. However, such a desired result of the present invention can be an obstacle for ion/ion reactions because the volumes filled by both reactants often only partially overlap. Therefore, the overlap can be improved by additional pulses on the lenses, e.g., DC pulses to lenses 121 and 128 as shown in FIG. 1A. In particular, the repulsive potentials generated by the lenses are increased by a short pulse (e.g., microsecond pulses) which urges the ions toward the center of the multipole trap, which increases the spatial overlap and thus improves reaction speed and yield.

Figure 6A:
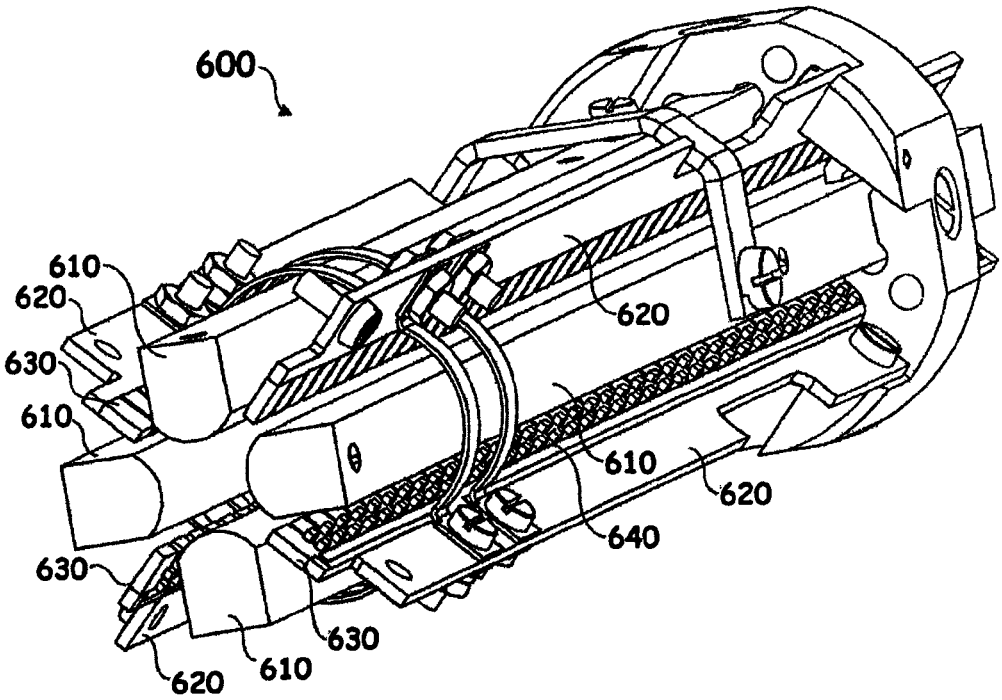
FIG. 6A shows a linear 2D quadrupole trap coupled to a structure(s) that enables coupling static DC field gradients of the present invention along the length of the device.

FIG. 6A shows an example beneficial device, as generally designated by the reference numeral 600, which utilizes structures to enable coupling of various DC fields and thus various potential shapes so as to provide for customized potential minima that can aid the reactions of the present invention. Such a device is often utilized in mass spectrometer systems, such as, but not limited to, the LTQ Orbitrap XL™ hybrid FTMS as described in WO 2009/147391, the disclosure of which is incorporated herein by reference in its entirety.

In particular, FIG. 6A shows coupled DC electrode structures 620 (e.g., vane electrodes) illustrated as example branched segments 630 (e.g., finger electrodes) configured on a printed circuit board (PCB) having metalized areas protruding into the quadrupole rods 610 of the multipole arrangement of FIG. 6A. The face of the circuit boards as configured with the branched segments 630 is interconnected by a resistor chain 640 having in some instances, predetermined capacitive elements (not shown) to reduce RF voltage coupling effects. Desired potential wells can thus be produced by supplying different voltages to the sides of the PCBs 620 with the resistive elements providing a respective voltage divider along lengths of the electrodes 620, or by supplying a voltage to one side and grounding the other. It is to be appreciated that a different shape of the potentials can also be provided by changing the values of the resistors 640. The relative positioning of the electrode structures 620 in FIG. 6A with respect to the rods 610 are designed to occupy positions that minimize interference with the RF polar fields resulting from the rods 610. Thus, along with the aforementioned RF voltage(s) and DC fields that can be applied as normal operation of the device, the DC electrode structures 620 of FIG. 6A, shown with an array of branched portions 630, is one means of beneficially providing for the additional axial DC electric field of often greater than about 30 mV/cm. Such an application induces resultant DC axial forces within multipole rods 610 to trap and or urge ions along a desired longitudinal direction of the multipole trap 600 so as to effect ion/ion reactions such as ETD.

Generally, the multipole device 600 as configured in an LTQ Orbitrap XL™ system is used to trap ions in the cell and then eject processed ions using a DC gradient so as to effect electron transfer dissociation in a "separate" ion trap. The resultant ETD reactants are subsequently directed back towards the direction of the collision cell so as to be mass analyzed by the Orbitrap™ analyzer.

Surprisingly, the system and in particular, the collision cell can be modified, as described in the present invention, so as to provide for an even higher abundance of detectable reactant ions for the Orbitrap™ based on the higher storage capability of the device and the minimization of transfer losses. The beneficial result is an increase in detectable signal to noise ratios of ion products. In particular, in addition to non-restrictions on the length of the collision device and the variability of $r_0$ both of which enable higher storage capacity of ions, such cells (i.e., HCD cells) are also capable of operating over a wider range of frequencies (e.g., up to about 2.4 MHz). Because of the higher range of frequencies, the RF voltages can be increased to also enable higher payload capacities to be available for detection by the Orbitrap™ mass analyzer. As a benefit, the collision cell in the above instrument is also arranged closer to the reagent source (i.e., the CI source) so as to minimize transfer losses and thus also provide higher detectable ion signals. Other benefits include a free choice on background gas pressures, which also improves storage and trapping of ions and reduces the diameter of the ion cloud so as to increase ion density and reaction speed.

Accordingly, using such device, analyte ions can be injected and trapped at potential minima location of the collision device and then reagent anions can be simultaneously injected and trapped at a second potential minima location of the device. Thereafter, ion/ion reactions can generally take place in the overlap region of the ion clouds to provide for high reaction rates with good fragmentation efficiencies. Resulting ions can be transferred into the mass analyzer as utilized in the commercially available LTQ Orbitrap XL™ system or any of the mass analyzer used and understood by those of ordinary skill in the art.

Figure 6B:
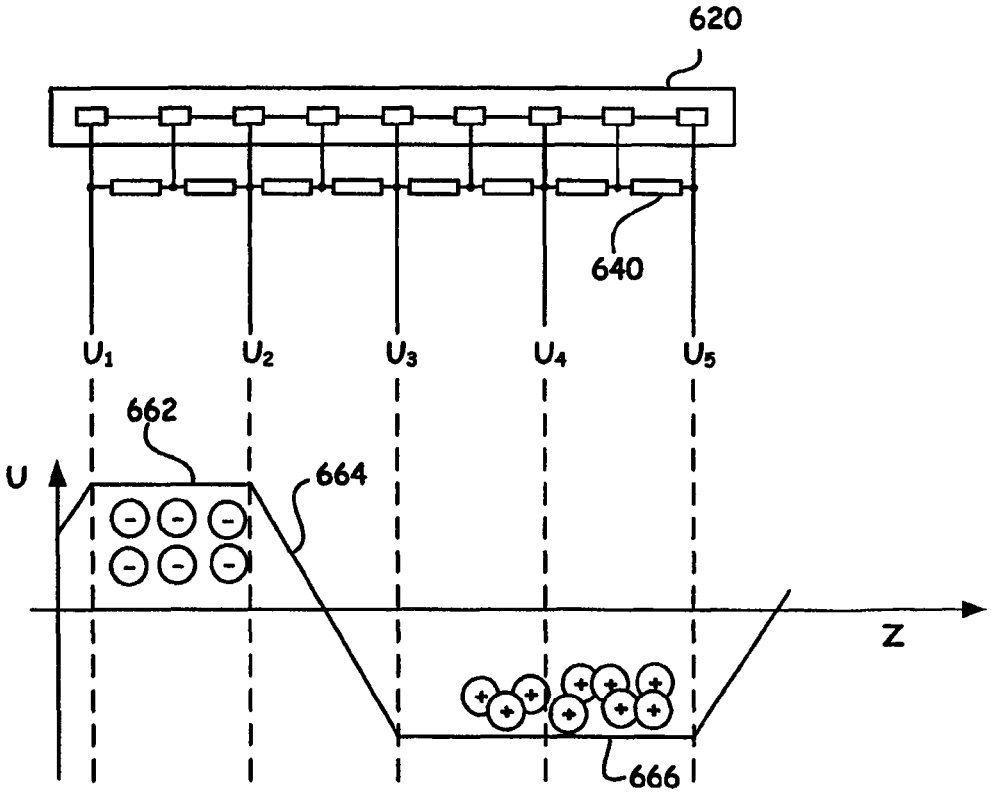
FIG. 6B schematically illustrates potential wells formed by the vane structures provided in FIG. 6A.

FIG. 6B illustrates the beneficial capabilities of the DC electrodes 620 described above. In particular, using controlled voltages applied to the vanes 620 and thus resistive elements described above, the gradient(s) 664 and resultant potential wells 662 and 666 of the present invention can be essentially customized to induce predetermined ion/ion reactions by supplying predetermined voltages to the vane structures 620/resistive elements 640. Thus, as shown by example in FIG. 6B, simultaneously injected negative ions (e.g., anions) can be trapped in a desired positive potential well 662 at one location of the multipole device 620 as enabled by $U_1$, $U_2$ and injected positive ions (e.g., cations) can be trapped in a formed negative potential well 666 resultant from desired potentials $U_3$, $U_4$, $U_5$. Ejection is enabled as described above. The important point to note is that the electrode structure for the device 600 enables variability of the storage potential volumes 662 and 666 and customized gradients 664 that include the capability of variation over time.

Figure 7A:
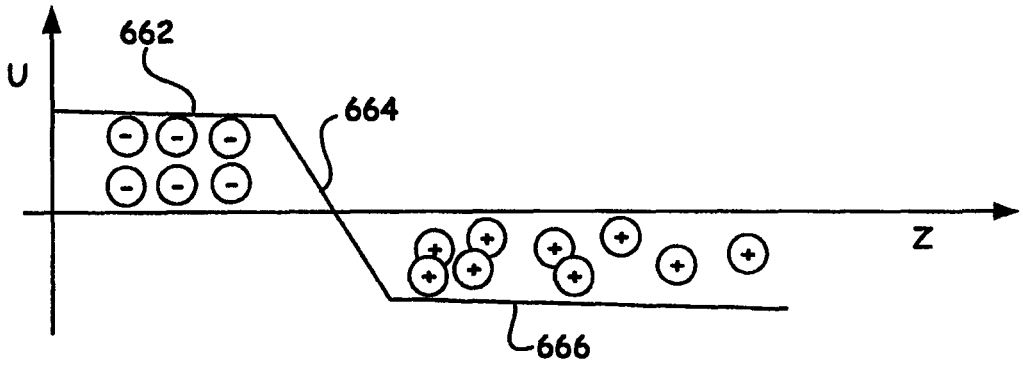
FIGS. 7A, 7B, and 7C are shown to merely illustrate the customization of various ion storage potential volumes and DC gradients of the present invention.
Figure 7B:
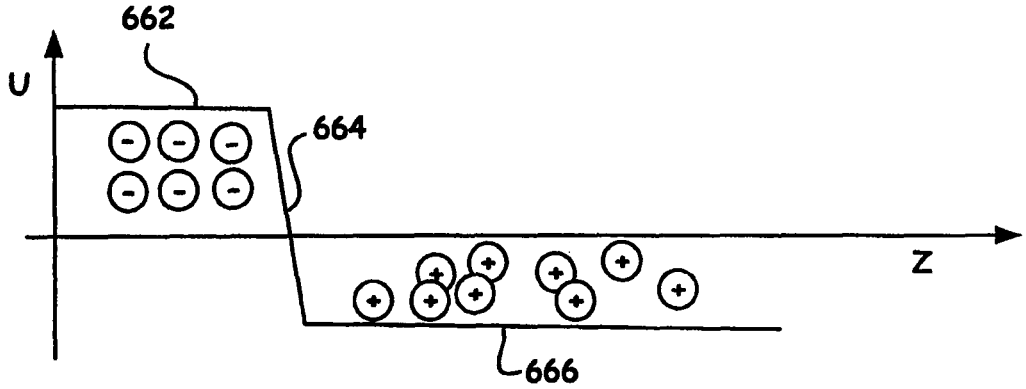
Figure 7C:
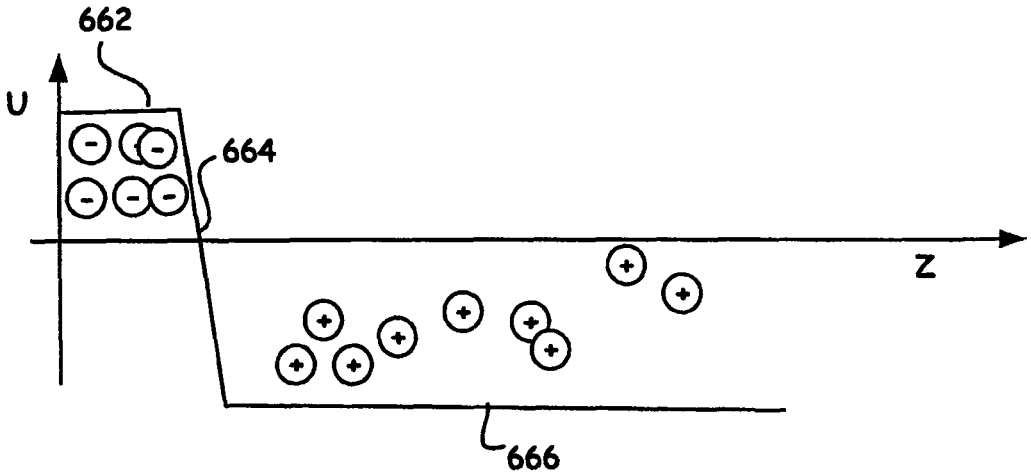

FIGS. 7A, 7B, and 7C are shown to merely illustrate the customization of various storage potential volumes 662 and 666 and customized gradients 664 (e.g., by applying DAC controlled voltages to the resistive stacks or by changing the values of the resistors in the stacks 640) along the length of the device using the structure 600 shown in FIG. 6A. Specifically, FIG. 7A, which is similar to the storage potential volumes 662 and 666 and customized gradients 664 shown in FIG. 6B can be formed via designed applied voltages to the resistive stacks 640 as described above. FIGS. 7B and 7C illustrate reconfigured potential storage volumes 662, 666 and gradients 664 using the structure 600 shown in FIG. 6A to provide for variations of the storage volumes and gradients that can enable variations of desired mixing reaction rates of the oppositely charged ions.

Figure 8A:
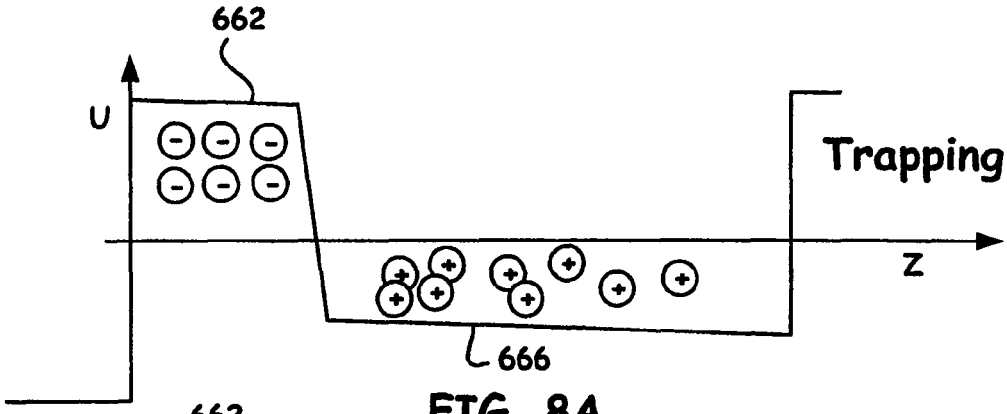
FIGS. 8A, 8B, 8C, and 8D illustrate the capability of time shifting customized storage volumes and gradients within a multipole device of the present invention.
Figure 8B:
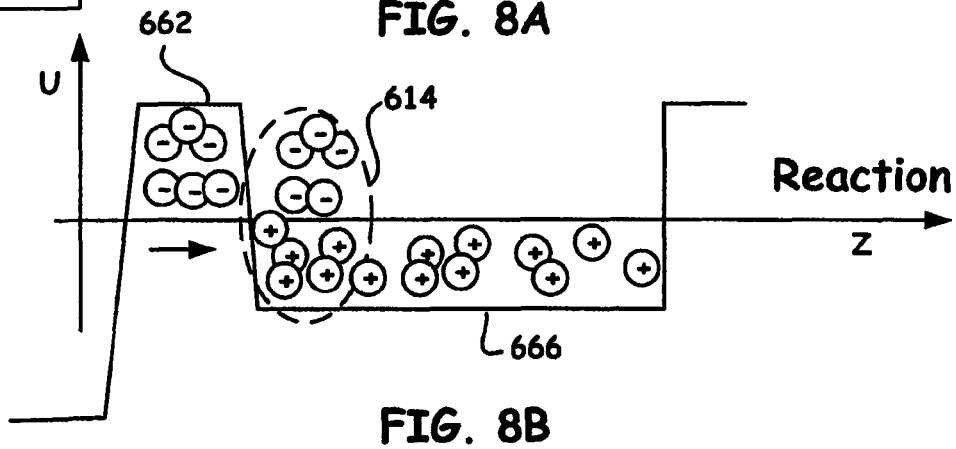
Figure 8C:
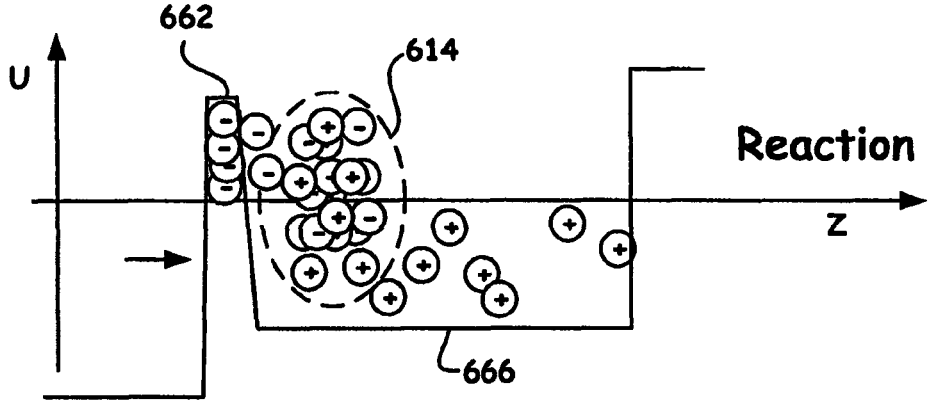
Figure 8D:
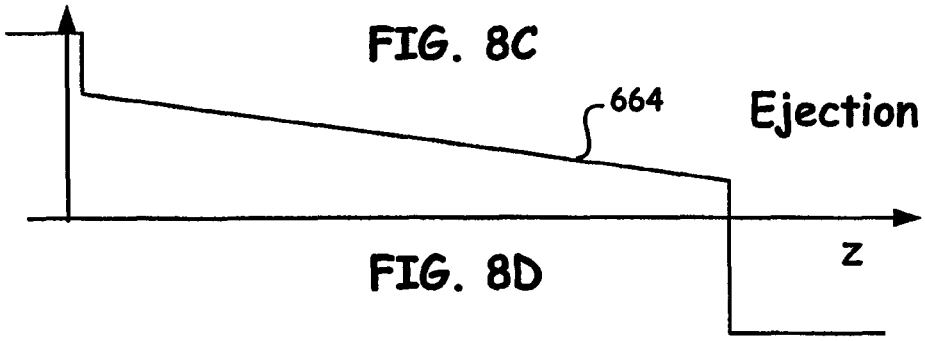

FIGS. 8A, 8B, and 8C are shown to merely illustrate the capability of variation over time of the potential storage volumes 662, 666 and gradients (not shown by reference character) using the cell 600 described with respect to FIG. 6A. In particular, FIG. 8A shows trapping of desired ions in storage volumes 662, 666 as described above. FIGS. 8B and 8C illustrates the manipulation over time of at least one of the storage volumes, in this case the storage volume 662 for the negative ions, so as to induce such ions to effectively move (as shown by the directional arrows) towards the oppositely charged ions to provide for enhanced reaction rates in the overlapping region 614. FIG. 8D shows an example ejection gradient 664 to direct resultant reactants to, for example, a mass analyzer as described above.

Results

Figure 9A:
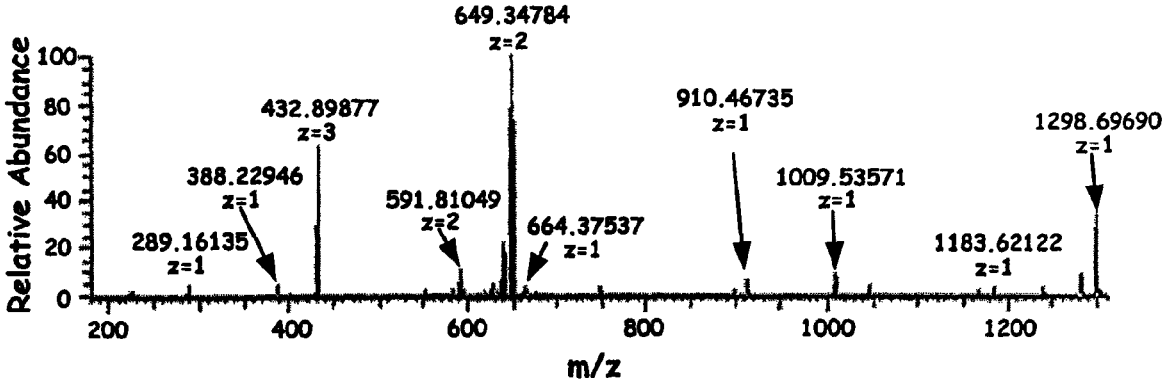
FIG. 9A shows ETD spectra results for a substance with well known fragmentation patterns from experiments carried out using a system of the present invention.
Figure 9B:
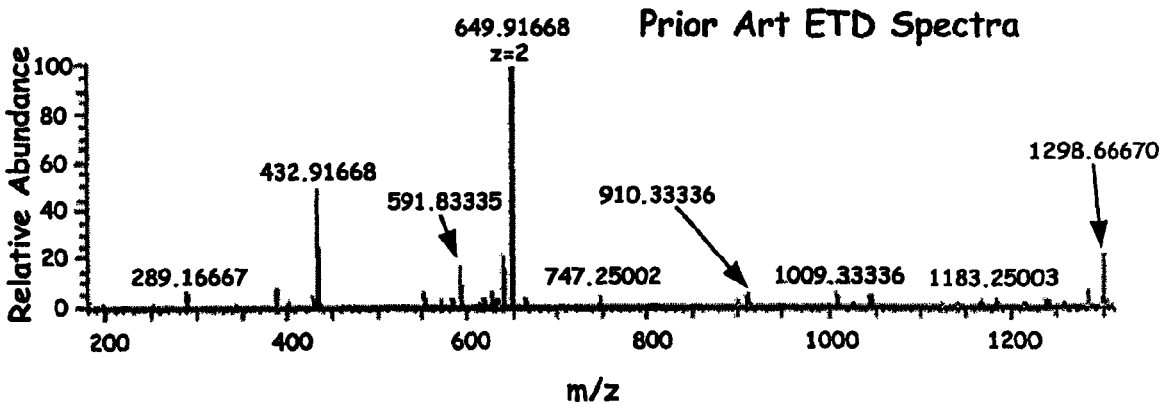
FIG. 9B shows ETD spectra resulting from a prior art system to illustrate a comparison of the spectra provided in FIG. 9A.

FIG. 9A shows ETD spectra results for a substance with well known fragmentation patterns from experiments carried out using a modified commercial LTQ Orbitrap XL ETD mass spectrometer, as discussed above. The firmware had been modified to implement the mode of operation as described by the present invention. Analyte ions were injected and trapped in one end of the device and then reagent ions were injected and trapped into the opposing end. Ion/ion reactions were enabled in the overlap region in the center of the device, as discussed herein. Then, the resulting ions were transferred into the mass analyzer of the system to provide the spectra shown in FIG. 9A. FIG. 9B shows a prior art known ETD spectra of the substances captured in the spectra shown in FIG. 9A. Accordingly, the spectra shown in FIG. 9A demonstrates the surprising yet remarkable capabilities of the present invention in providing similarly produced data but in a novel way.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

What is claimed is:

1. A method of fragmenting ions, comprising:

introducing populations of a first group of ions and a second group of ions of opposite polarity to said first group of ions into an ion channel as defined within a two-dimensional multipole;

providing along with a radially confining field, an additional static DC gradient along the axial length of said ion channel so as to axially confine within said ion channel said first group of ions in an adjacent location with respect to said second group of ions of opposite polarity; and arranging the slope of the DC gradient so that said introduced first group of ions and said second group of ions of opposite polarity have a range of overlap for ion/ion interactions of said introduced first group and said second group of ions to produce product ions by said first group of ions interacting with said second group of ions of opposite polarity and/or by way of space charge.

2. The method of claim 1, wherein the arranging step further comprises having the DC gradient configured with a gradient ranging from kT/L to several kt/L.

3. The method of claim 1, wherein the arranging step further comprises having the DC gradient configured with a gradient ranging from 30 mV/cm up to 1 V/cm.

4. The method of claim 1, wherein the arranging step further comprises interacting said first group of ions with said second group of ions of opposite polarity by increasing the ion population of at least one of said first group of ions and said second group of ions of opposite polarity so as to increase space charge, optionally wherein increasing the ion population further comprises increasing either said first group of ions of opposite polarity by repeated injections during the ion/ion interactions.

5. The method of claim 4, wherein the arranging step further comprises interacting said first group of ions with said second group of ions of opposite polarity by forcing ions through one another.

6. The method of claim 5, wherein the forcing of said ions through one another further comprises injecting said ions of opposite polarity through the location where the population of a first group of ions are contained.

7. The method of claim 5, wherein the forcing of said ions through one another further comprises switching the trapping potential of said additional static DC gradient, optionally wherein the forcing of said ions through one another further comprises introducing said second group of ions of opposite polarity about a location having a population of said first group of prior contained ions after switching the trapping potential so as to enable said first group of prior contained ions to be forced through said ions of opposite polarity, and optionally wherein the introducing of said second group of ions of opposite polarity is delayed by a predetermined time frame after switching the trapping potential so as to enable spatial overlap between said introduced second group of ions of opposite polarity and slow moving said first group of ions.

8. The method of claim 1, wherein the step of providing for an additional static DC gradient further comprises providing for a plurality of customized ion storage volumes and a customized additional static DC gradient and optionally time shifting said plurality of customized ion storage volumes to enhance the ion/ion interactions.

9. The method of claim 1, wherein the step of introducing populations of either said first group of ions or said second group of ions of opposite polarity further comprises: subjecting said ions to a reverse gradient by said additional static DC field so as to be confined at a distant location within said ion channel.

10. The method of claim 1, wherein the arranging step further comprises said introduced groups of ions being comprised of precursor and reagent ions interacting with each other so that charge may be transferred from the reagent ions to the precursor ions.

11. The method of claim 1, wherein the arranging step further comprises said introduced groups of ions being comprised of precursor and reagent ions interacting with each other so that the charge transfer induces charge reduction of a multiply charged precursor ion and/or a charge reversal of the precursor ions.

12. The method of claim 1, wherein the arranging step further comprises said introduced groups of ions being comprised of precursor and reagent ions interacting with each other so that charge transfer dissociates the precursor ions into two or more fragments.

13. The method of claim 1, wherein the arranging step further comprises electron transfer dissociation (ETD).

14. The method of claim 1, further comprising a step of mass analyzing the product ions.

15. A mass spectrometer system, comprising:

at least one ion supplier to provide for a first group of ions and a second group of ions of opposite polarity to said first group of ions;

a two-dimensional multipole configured to receive populations of said first group of ions and said second group of ions of opposite polarity to said first group of ions within a defined ion channel; and a controller configured to couple periodic voltages to a first set of electrodes provided by said two-dimensional multipole so as to radially confine said received first group of ions and said second group of ions of opposite polarity, and wherein said controller is additionally configured to couple an additional static DC voltage gradient along the length of said ion channel so that resultant axial forces can confine said first group of ions and said second group of ions of opposite polarity adjacent to each other within said ion channel; wherein the slope of the DC voltage gradient can be arranged so that said confined first group of ions and said second group of ions of opposite polarity have a range of overlap whereby ion/ion reactions can be arranged to produce desired product ions by said first group of ions interacting with said second group of ions of opposite polarity by way of diffusion and/or by way of space charge.

16. The mass spectrometer system of claim 15, wherein said two-dimensional multipole comprises at least one multipole electrode assembly selected from a quadrupole, hexapole, an octapole.

17. The mass spectrometer system of claim 16, wherein said two-dimensional multipole comprises a collision cell.

18. The mass spectrometer system of claim 15, wherein buffer gases are provided within said two-dimensional multipole with pressures in the range between about 0.001 mbar down to about 0.0005 mbar.

19. The mass spectrometer system of claim 15, wherein said static DC voltage gradient is configured with a gradient ranging from about 30 mV/cm up to about 1 V/cm.

20. The mass spectrometer of claim 15, wherein said static DC voltage gradient is provided by at least one auxiliary electrode coupled to a DC voltage source via said controller, said at least one auxiliary electrode further comprising:

electrical elements including at least one array of finger electrodes and a plurality of resistors interconnecting respective finger electrodes of the at least one array so as to enable customized voltage gradients and ion storage volumes along the axial length of said two-dimensional multipole.

* * * * *

UNITED STATES PATENT AND TRADEMARK OFFICE

CERTIFICATE OF CORRECTION

PATENT NO. : 8,604,419 B2
APPLICATION NO. : 12/700605
DATED : December 10, 2013
INVENTOR(S) : Dirk Nolting et al.

It is certified that error appears in the above-identified patent and that said Letters Patent is hereby corrected as shown below:

In the Claims

Claim 1, column 21, line 26:
replace "of opposite polarity and/or by way of space charge"
with --of opposite polarity by way of diffusion and/or by way of space charge--

Signed and Sealed this
Fifteenth Day of April, 2014

Michelle K. Lee

Michelle K. Lee
*Deputy Director of the United States Patent and Trademark Office*